US005553664A

United States Patent [19]

Nishishita et al.

[11] Patent Number: 5,553,664

[45] Date of Patent: Sep. 10, 1996

[54] LAMINATED HEAT EXCHANGER

[75] Inventors: Kunihiko Nishishita; Takashi Kinugawa, both of Konan, Japan

[73] Assignee: Zexel Corporation, Tokyo, Japan

[21] Appl. No.: 243,769

[22] Filed: May 17, 1994

[30] Foreign Application Priority Data

May 20, 1993 [JP] Japan ..... 5-141460
Dec. 2, 1993 [JP] Japan ..... 5-338824

[51] Int. Cl.[6] ..... F28D 1/02

[52] U.S. Cl. ..... 165/153; 165/167; 165/173; 165/176

[58] Field of Search ..... 165/176, 167, 165/153, 152, 178, 173

[56] References Cited

U.S. PATENT DOCUMENTS

| | | | |
|---|---|---|---|
| 4,274,482 | 6/1981 | Sonoda | 165/153 |
| 4,589,265 | 5/1986 | Nozawa | 165/153 X |
| 4,809,518 | 3/1989 | Murayama | 62/225 |
| 4,821,531 | 4/1989 | Yamauchi et al. | 165/153 X |
| 5,024,269 | 6/1991 | Noguchi et al. | 165/153 |
| 5,042,577 | 8/1991 | Suzumura | 165/153 |
| 5,094,293 | 3/1992 | Shinmura | 165/153 X |
| 5,236,336 | 8/1993 | Hitoshi | 165/176 X |

FOREIGN PATENT DOCUMENTS

| | | | |
|---|---|---|---|
| 0271084 | 6/1988 | European Pat. Off. . | |
| 0055596 | 3/1986 | Japan | 165/153 |
| 62-46195 | 2/1987 | Japan | 165/153 |
| 0238291 | 9/1990 | Japan | 165/153 |
| 0221789 | 9/1991 | Japan | 165/176 |
| 4184093 | 4/1992 | Japan | 165/173 |

*Primary Examiner*—John Rivell
*Assistant Examiner*—Christopher Atkinson
*Attorney, Agent, or Firm*—Wenderoth, Lind & Ponack

[57] ABSTRACT

An intake/outlet passage forming plate is provided with an entrance/exit section onto which an expansion valve is mounted. A first coolant passage communicates between one side of the intake/outlet section and one end of a coolant path and a second coolant passage that connects the other side of the intake/outlet section and the other end of the coolant path via a communicating pipe. With this structure, the shapes of the first and second coolant passages in the intake/outlet passage forming plate can be changed, making it possible to have the entrance/exit section, onto which the expansion valve is mounted, communicate freely with the outflow/inflow sides of the coolant path. Also, by providing a plurality of tanks to communicate between the communicating pipe and the tank groups at one end of the coolant path, and by changing the communicating positions, the heat exchanging capacity is improved.

18 Claims, 25 Drawing Sheets

LAMINATED HEAT EXCHANGER

BACKGROUND OF THE INVENTION

1. Field of the Invention

The present invention relates to a laminated heat exchanger that is used for automotive air conditioning systems, in particular to a laminated heat exchanger which is structured by laminating a plurality of heat exchanging elements, each of which is provided with a pair of tanks that communicate with each other through a U-shaped passage, together with a plurality of corrugated fins.

2. Description of the Related Art

In recent years, depending upon the layout of the engine compartment of the vehicle, it is often the case that positioning the entry pipe or the expansion valve at the tank in the lower section of a heat exchanger creates a hindrance. To deal with this problem, the entry pipe is not normally led out at the end plate side of the heat exchanger. Instead it is led out at the front of the heat exchanger and the piping is disposed at a specific height by leading the pipe around.

However, with this method, the problem of reduced cooling capacity is likely to arise, as the ventilating resistance is increased by the entry pipe, the expansion valve which is connected to the entry pipe, and the like. In order to eliminate this problem, the heat exchanger disclosed in Japanese Patent Unexamined Publication 3-170755 has an entry pipe located on the surface on the side.

This example makes it possible to provide an entry pipe on one side by forming a central tank group or a pipe between a pair of tanks when structuring a coolant path with four or more routes.

However, in the example described above, since the pitch of the entrance to the expansion valve and the pitch of the heat exchanger entrance do not match, a space for mounting the expansion valve is required. Also, as it is necessary to maneuver the entry pipe to this space, no space saving can be realized. Another problem is that the number of components increases.

SUMMARY OF THE INVENTION

The object of the present invention is to provide a laminated heat exchanger with a simple structure which facilitates the mounting of an expansion valve so as to achieve a space saving and which also realizes an improvement in heat exchanging capability.

In order to achieve this object, the present invention is provided with a plurality of heat exchanging elements, each of which is provided with a pair of tanks and a U-shaped passage that communicate between the two tanks. These heat exchanging elements are laminated alternately with a plurality of corrugated fins. End plates are provided at both ends in the direction of the lamination, and U-shaped passages that communicate between the tanks of the various adjacent heat exchanging elements are formed as necessary to communicate between one tank group and another tank group in such a way that these groups of tanks are partitioned to form a coolant path with a plurality of routes. The laminated heat exchanger is further provided with an entrance/exit section to which an expansion valve is mounted and which is bonded onto one of the aforementioned end plates. An intake/outlet passage that is formed in one of the aforementioned end plates and is provided with a first coolant passage that communicates with the tank group at one end of the aforementioned coolant path and one side of the aforementioned entrance/exit section, a second coolant passage that communicates with the other side of the aforementioned entrance/exit section and a pipe insertion hole that is formed in one of the aforementioned end plates, and a communicating pipe, one end of which communicates with the aforementioned second coolant passage by being bonded to the aforementioned pipe insertion hole and the other end of which communicates with the tank group at the other end of the aforementioned coolant path.

Therefore, according to the present invention, since the entrance/exit section onto which the expansion valve is mounted, and the intake/outlet passage forming plate that is provided with the first coolant passage that communicates between one side of the entrance/exit section and one end of the coolant path, and the second coolant passage that is connected to the other side of the aforementioned entrance/exit section and the other end of the coolant path via the communicating pipe are both bonded to one of the end plates, the entrance/exit section onto which the expansion valve is mounted and the inflow/outflow sides of the coolant path can be made to communicate freely by varying the form of the first and second coolant passages in the intake/outlet passage forming plate.

Also, in the present invention, the aforementioned communicating pipe may be provided at the side of the aforementioned tank groups. One end of this pipe communicates with the first pipe insertion hole, which is formed in the extended portion that extends to one side from the lower section of the end plate and the intake/outlet passage forming plate which is bonded onto this end plate. This pipe insertion hole, in turn, communicates with the second coolant passage. The other end of the communicating pipe communicates with the second pipe insertion hole which is formed in the extended portion that extends to one side from a specific tank in the tank group which is positioned at the other end of the aforementioned coolant path. Alternately, this communicating pipe may be provided in a pipe insertion groove which is formed between the aforementioned one tank group and the other tank group, with one end communicating with the first pipe insertion hole that is formed at the center of the lower area of the aforementioned end plate and the intake/outlet passage forming plate which is bonded on to the end plate and which communicates with the second cooling path, the other end communicating with the second pipe insertion hole that is formed at the center of the lower area of the other end plate and, at the same time, with a by-pass being formed in the aforementioned other end plate to communicate between the second pipe insertion hole and the end of the tank group which is at the other end of the aforementioned coolant path.

As a result, since the aforementioned communicating pipe is provided at the side of the tank group or, alternately, a pipe insertion groove is formed between one tank group and the other to accommodate the aforementioned communicating pipe, the necessity for leading the pipe through the area where heat exchanging is performed in the heat exchanger is eliminated.

Also, in the present invention, the aforementioned communicating pipe may be provided in the pipe insertion groove which is formed between the aforementioned one tank group and the other tank group, with one end communicating with the first pipe insertion hole, which is formed at the center of the lower area of the aforementioned end plate and the intake/outlet passage forming plate which is bonded onto the end plate and which communicates with the aforementioned second coolant passage, the other end communicating astride the extended portions which extend to the side of the pipe insertion groove from at least two tanks that do not lie adjacent to each other in the tank group at the other end of the aforementioned coolant path.

Furthermore, the aforementioned communicating pipe may be provided in the pipe insertion groove which is formed between the aforementioned one tank group and the other tank group, one end communicating with the first pipe insertion hole that is formed at the center of the lower area of the aforementioned end plate and the intake/outlet passage forming plate which is bonded onto the end plate and which communicates with the aforementioned second coolant passage, the other end communicating with the extended portion which extends to the side of the pipe insertion groove from the tank that is positioned at a specific position towards the outside from the center of the tank group which is at the other end of the aforementioned coolant path.

Yet again, the aforementioned communicating pipe may be provided in the pipe insertion groove which is formed between the aforementioned one tank group and the other tank group, one end communicating with the first pipe insertion hole, which is formed at the center of the lower area of the aforementioned end plate and the intake/outlet passage forming plate which is bonded onto the end plate and which communicates with the aforementioned second coolant passage, and the other end of which communicates with the extended portion that extends to the side of the pipe insertion groove from a tank which is one of the tanks in the tank group at the other end of the aforementioned coolant path and which is structured with at least two continuous formed plates.

Therefore, it is possible to achieve an improvement in the flow of the coolant from the communicating pipe to the tank group or from the tank group to the communicating pipe as well as an improvement in the temperature distribution because the other end of the aforementioned communicating pipe communicates astride the extended portions that extend toward the pipe insertion groove from at least two tanks which are not adjacent to each other in the tank group that is at the other end of the aforementioned coolant path. The other end of the aforementioned communicating pipe communicates with the extended portion that extends toward the pipe insertion groove from the tank that is positioned at a specific position toward the outside from the center of the tank group at the other end of the aforementioned coolant path. Or, the other end of the aforementioned communicating pipe communicates with the extended portion that extends toward the pipe insertion groove from the tank that is one of the tanks in the tank group at the other end of the aforementioned coolant path and which is structured with at least two continuous formed plates.

BRIEF DESCRIPTION OF THE DRAWINGS

Many other advantages, features and objects of the present invention will be understood by those of ordinary skill in the art by referring to the attached drawings, which illustrate preferred embodiments of the present invention, in which:

FIG. 26 (*b*) is a partial cross section illustrating a bonding of the communicating pipe and a second pipe insertion hole;

FIG. 27 (*b*) is a partial cross section showing a heat exchanging element side of the communicating pipe, both ends of which are provided with a guide.

DETAILED DESCRIPTION OF THE PREFERRED EMBODIMENTS

Figure 1:
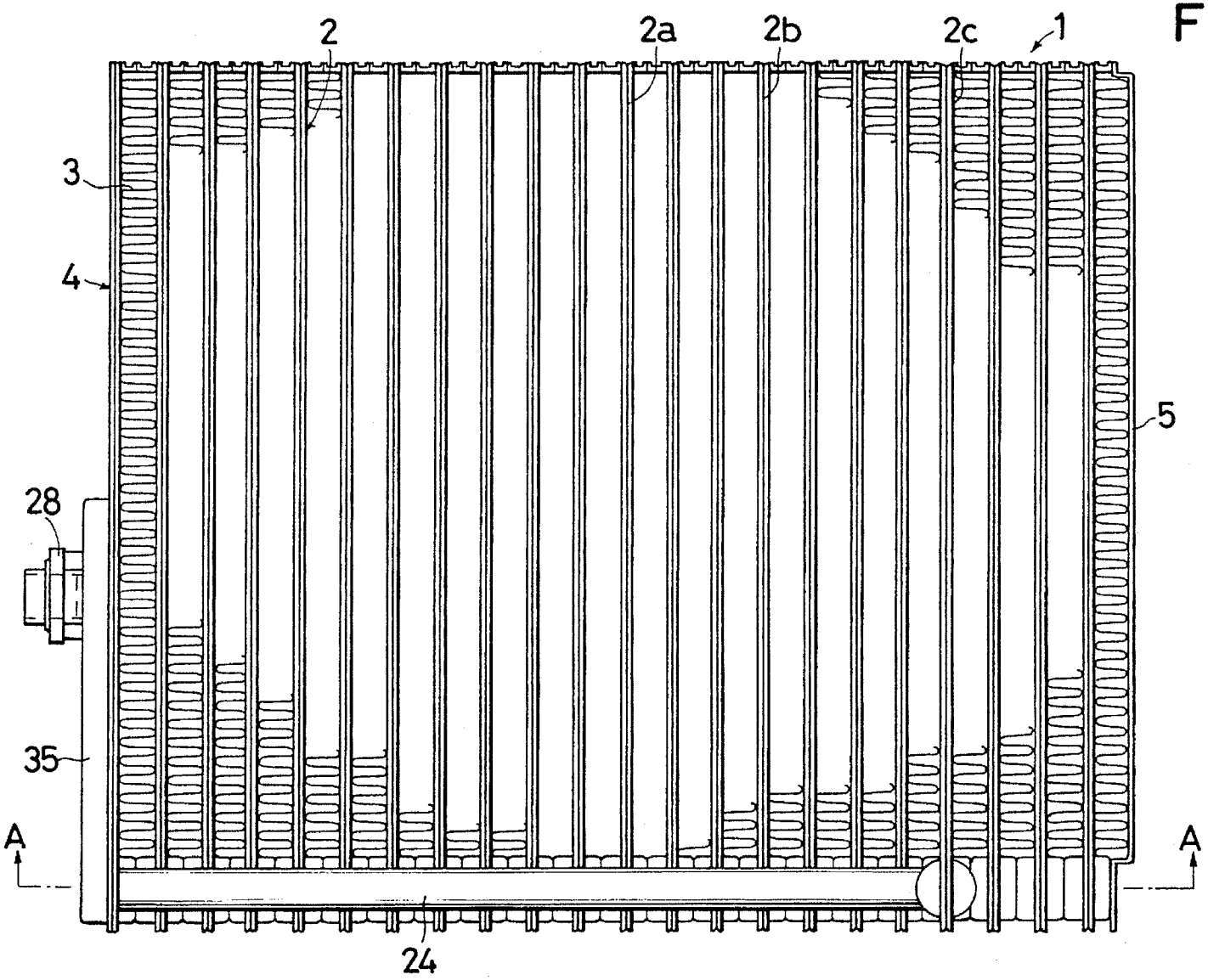
FIG. 1 is a front elevation of a laminated heat exchanger in a first embodiment.
Figure 2:
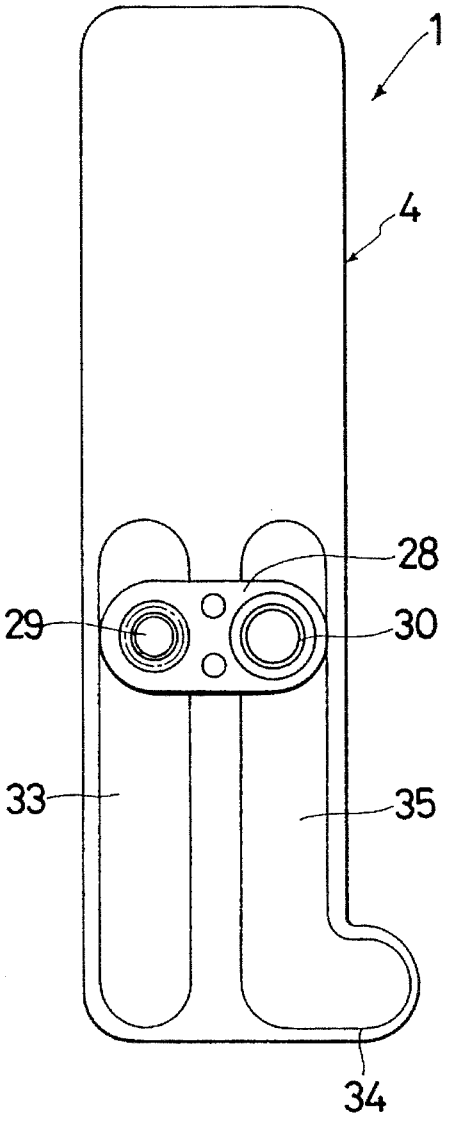
FIG. 2 is a side elevation of the laminated heat exchanger in the first embodiment.

The following is an explanation of the embodiments of the present invention with reference to the drawings.

The laminated heat exchanger 1 (hereafter referred to as "heat exchanger") which is disclosed in the first embodiment as shown in FIGS. 1–5 may be a heat exchanger with, for example, six routes and it is assembled by laminating heat exchanging elements 2 and corrugated fins 3 alternately with end plates 4 and 5 provided at both sides in the direction of the lamination, with the assembled structure being brazed as a unit in a furnace.

The heat exchanging elements 2 (2*a*, 2*b*, 2*c*) are structured by joining formed plates facing each other, and in this embodiment they are structured with four different types of formed plates, that is, formed plates 6, 7, 8 and 9.

Figure 4:
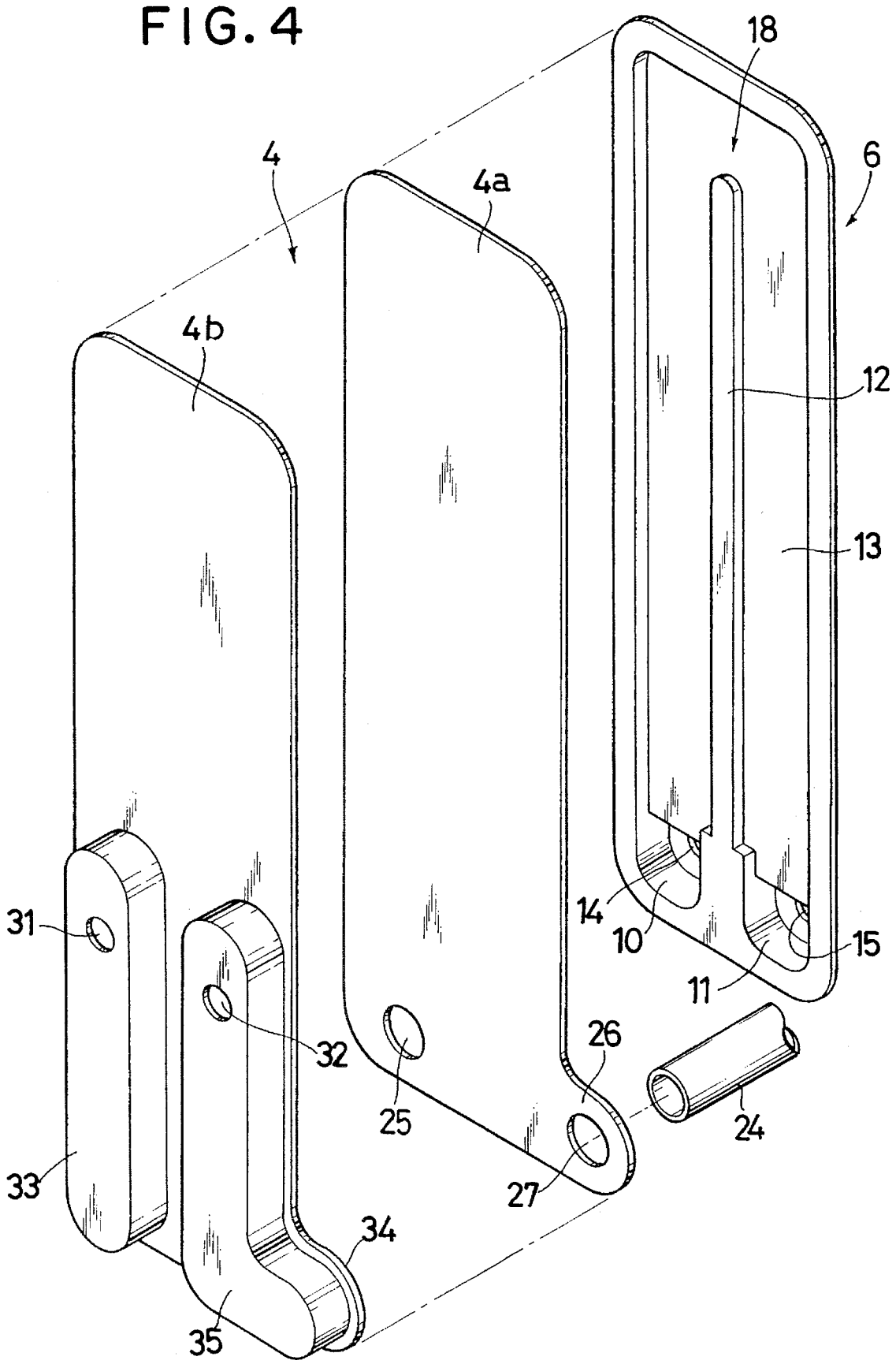
FIG. 4 is an exploded perspective view of the area of an end plate in the first embodiment.

The formed plate 6 is provided with two indented portions 10, 11 which are formed by distending the lower portion thereof, as shown in FIG. 4 and is also provided with the elongated raised member 12 which separates the two indented portions 10, 11 and which extends upwards. Around the peripheral edge of the elongated raised member 12, a U-shaped groove 13 that communicates between the aforementioned indented portions 10, 11 is formed. Also, opening portions 14, 15 are formed in the aforementioned indented portions 10, 11, respectively. The formed plate 7 has only one of the opening portions 14, 15 (for example, the opening portion 15) actually open.

Figure 3:
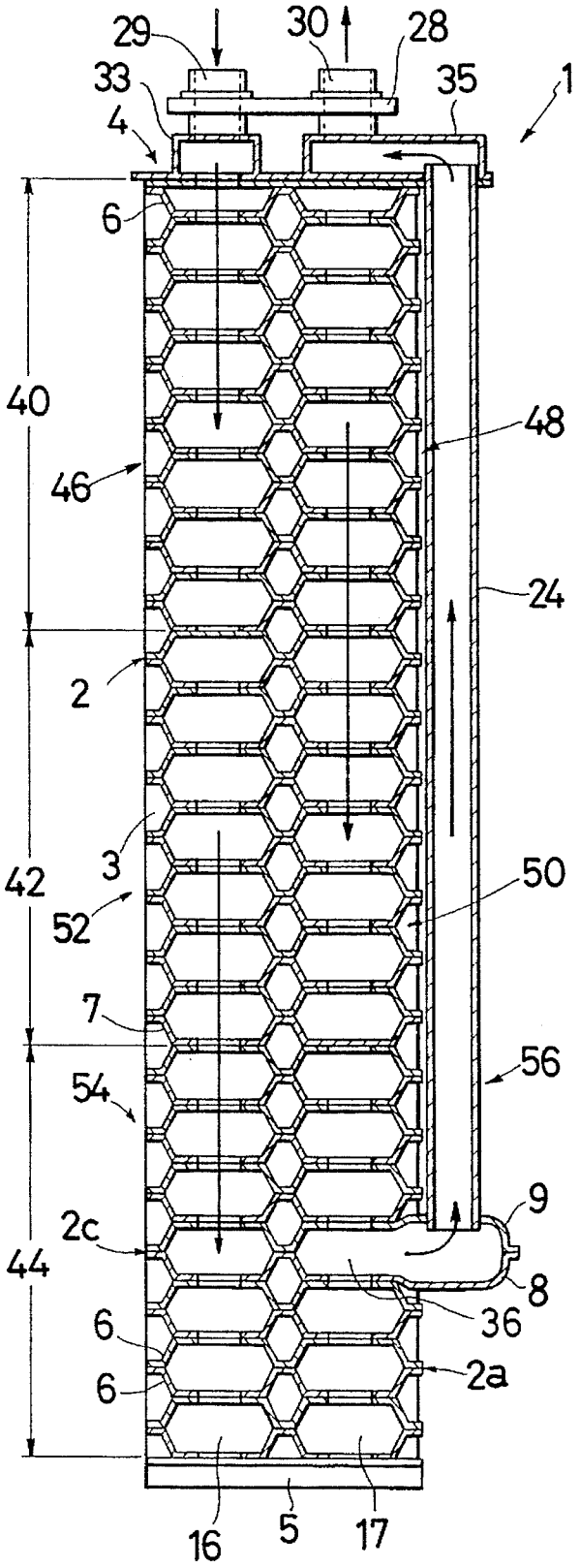
FIG. 3 is a cross section through a line A—A of the laminated heat exchanger in FIG. 1.

The heat exchanging element 2*a*is formed by bonding the formed plates 6, 6 so as to face each other. Within the heat exchanging element 2*a*, the tanks 16, 17 shown in FIG. 3 are formed by the indented portions 10, 11 which face each other and the U-shaped passage 18 is formed by the two U-shaped grooves 13. With the heat exchanging elements 2*a*, the tanks which are in contact with each other among the adjacent heat exchanging elements communicate with each other.

The heat exchanging element 2*b* is formed by bonding the aforementioned formed plates 6, 7 facing each other. The whole structure is built so that the heat exchanging elements 2*b* and the aforementioned heat exchanging elements 2*a* communicate between the adjacent tanks on one side while the tanks on the other side are blocked off from each other.

Figure 5:
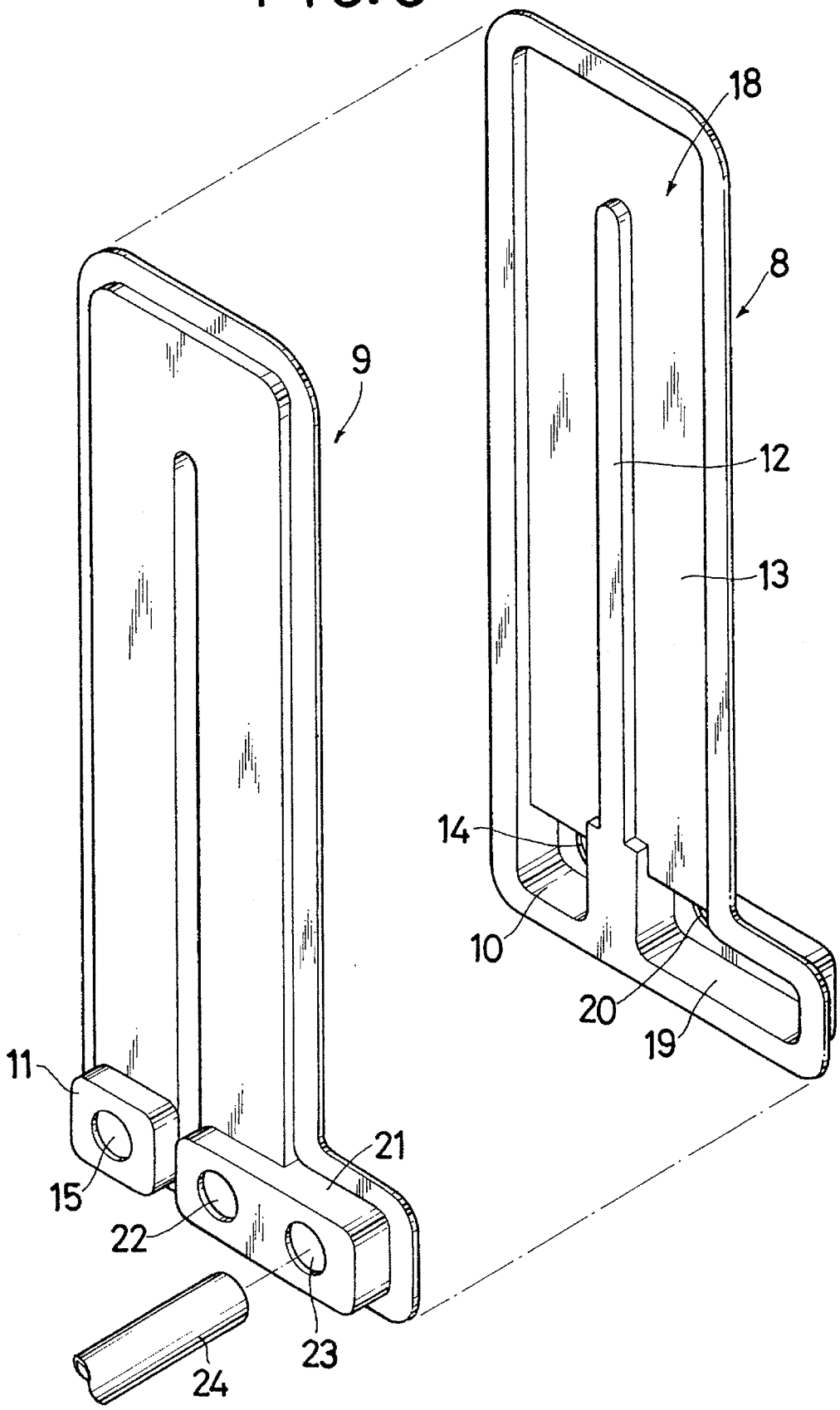
FIG. 5 is an exploded perspective of a heat exchanging element into which a communicating pipe is inserted.

The heat exchanging element 2*c* is formed by bonding the formed plates 8, 9 facing each other, as shown in FIG. 5. The formed plate 8 has its lower portion distended to form the indented portions 10, 19. The indented portion 19, in particular, is formed in such a manner that it extends over a specific width to the side from the heat exchanging elements 2*a*, 2*b*. It has an opening portion 20 formed in a position that corresponds to that of the aforementioned opening portions 14, 15. Also, the formed plate 9 has a shape that is symmetrical to the formed plate 8 so that it can form the heat exchanging element 2*c* when bonded with the aforementioned formed plate 8. In an indented portion 21 which is formed in the formed plate 9 at a position that corresponds to that of the aforementioned indented portion 19, an opening portion 22 is formed at a position that corresponds to that of the aforementioned opening portions 14, 15. To its side, a pipe insertion hole 23 (second pipe insertion hole) is formed, into which one end of the communicating pipe 24 is inserted.

The heat exchanging elements 2 (2*a*, 2*b* , 2*c*) which are formed by the formed plates 6, 7, 8, 9 as described above are laminated while clamping the corrugated fins 3, and at both ends in the direction of the lamination, end plates 4, 5 are provided.

The end plate 4 is structured with a flat plate 4*a*and the intake/outlet passage forming plate 4*b*. The flat plate 4*a*blocks off the formed plate 6 which is positioned at the end of the heat exchanging element group to form the heat exchanging elements at the far end. In this flat plate 4*a*, a coolant intake hole 25 which opens into the indented portion 10 of a formed plate 6, the flange portion 26 which extends out in the form of a semi circle at a position corresponding to that of the extension of the aforementioned indented portion 19, and a pipe insertion hole (first pipe insertion hole) 27 which is formed in the flange portion 26 for fitting the communicating pipe 24, are formed.

The intake/outlet passage forming plate 4*b* is bonded to the flat plate 4*a*by brazing or the like to form the end plate 4, which is comprised of: a flange portion 34 which corresponds to the aforementioned flange portion 26, a first coolant passage 33 which communicates between the intake hole 31 into which the intake pipe 29 of an entrance/exit section 28 described below is mounted and the aforementioned coolant intake hole 25, a second coolant passage 35 which communicates with an outlet hole 32 into which an outlet pipe 30 of the entrance/exit section 28 is mounted and the pipe insertion opening 27, which is the opening end of the communicating pipe 24 and which opens into the aforementioned flange portion 34.

Note that an expansion valve (not shown) is mounted on the aforementioned entrance/exit section 28 and the coolant outlet of the expansion valve is connected to the aforementioned intake pipe 29 and the aforementioned outlet pipe 30 is connected to a passage, for example, in which a thermosensing tube is provided.

In the heat exchanger 1 which is structured as described above, the coolant that has reached the first coolant passage 33 from the expansion valve through the intake pipe 29 flows into a tank group 46 of a heat exchanging element group 40 via the coolant intake hole 25, as shown in FIG. 3. The coolant which then flows into a tank group 48 on the other side from tank group 46 by going through the U-shaped passages (going and returning) of the heat exchanging element group 40, now flows into a tank group 50 of a heat exchanging element group 42 which communicates with the tank group 48. The coolant then reaches a tank group 52 on the other side from a tank group 50 by way of the U-shaped passages of the heat exchanging element group 42. From the tank group 52, it then passes to a tank group 54 of a heat exchanging element group 44, the U-shaped passages (not shown) and a tank group 56. With this, the liquid coolant will have traveled six routes through the heat exchanging elements 2. The heat of the air passing through the fins 3 is absorbed through the fins 3 and the liquid coolant is evaporated into a gaseous coolant.

The coolant which has reached a tank group 56 at the extreme downstream side then travels to the communicating pipe 24 via a tank 36 (communicating passage) formed by the indented portions 19 and 21. It then passes through the communicating pipe 24 and reaches a second coolant passage 35. Then it is sent from the outlet pipe 30 to the next cooling cycle process.

This enables installation of the expansion valve at a correct position, since the shapes of the first coolant passage 33 and the second coolant passage 35 can be changed by changing the shape of the intake/outlet passage forming plate 4*b* and consequently the mounting position of the entrance/exit section 28 can be changed as appropriate.

Figure 6:
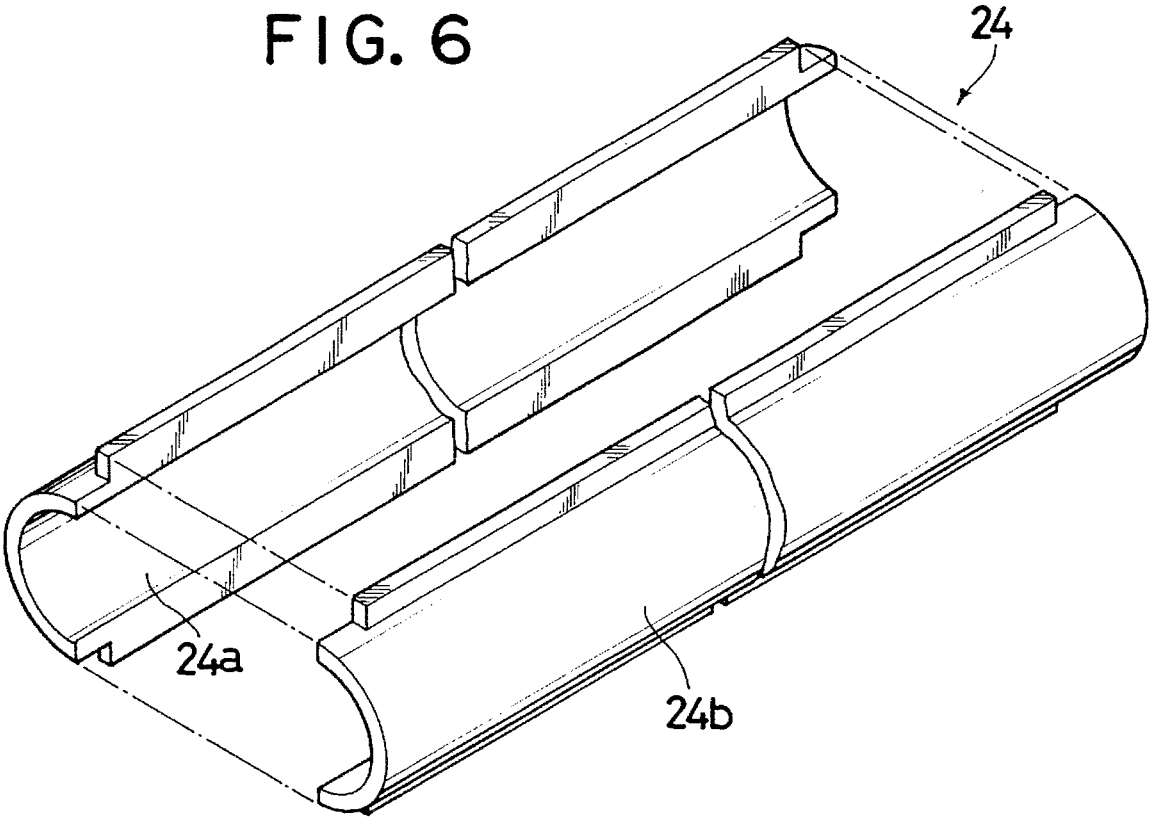
FIG. 6 is an exploded perspective view of the communicating pipe in another embodiment.

Note that FIG. 6 shows members 24*a*, 24*b*, which are formed of a material similar to that of the formed plates, such as clad material and which are formed as two equal portions of the aforementioned communicating pipe 24. By assembling these members 24*a*, 24*b* and by brazing them together with the heat exchanger in the furnace, the communicating pipe 24 is formed. Using the same material, thus, will prevent such problems as dimensional irregularities caused by differences in thermal expansion rates among various materials.

Figure 7:
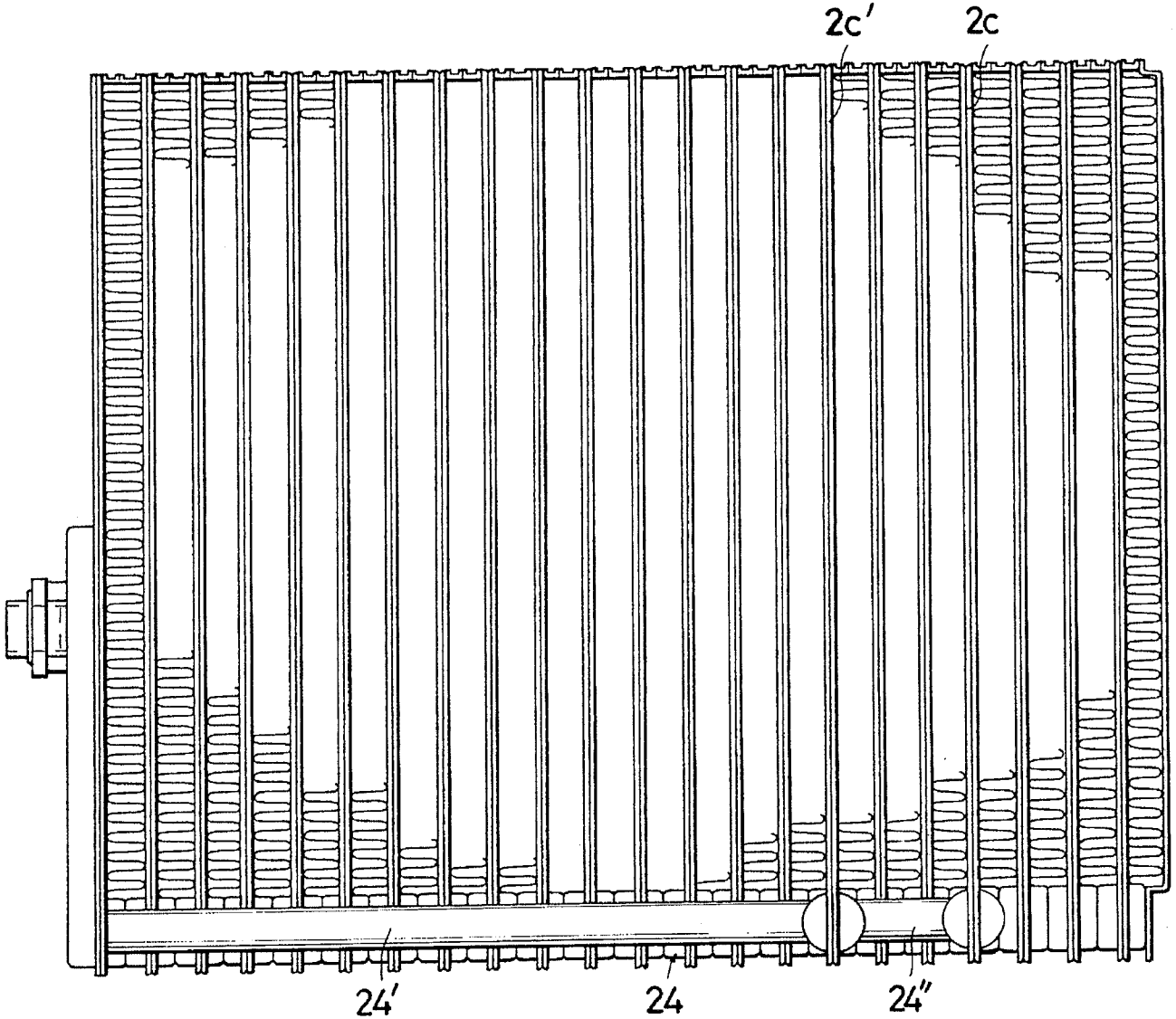
FIG. 7 is a front elevation of a laminated heat exchanger in a second embodiment.

Also, the second embodiment, shown in FIG. 7, has the communicating pipe 24 divided into a communicating pipe 24' and a communicating pipe 24". This embodiment is provided with the aforementioned heat exchanging elements 2*c* and a heat exchanging elements 2*c'* in which a pipe insertion hole is formed at a position that faces opposite the pipe insertion hole 23 of a heat exchanging elements 2*c*. The aforementioned end plate 4 and the heat exchanging elements 2*c'* communicate via the communicating pipe 24' and the aforementioned heat exchanging elements 2*c'* and the heat exchanging elements 2*c* communicate via the communicating pipe 24". This achieves a reduction in the passage resistance reading to the communicating pipe 24.

Figure 8:
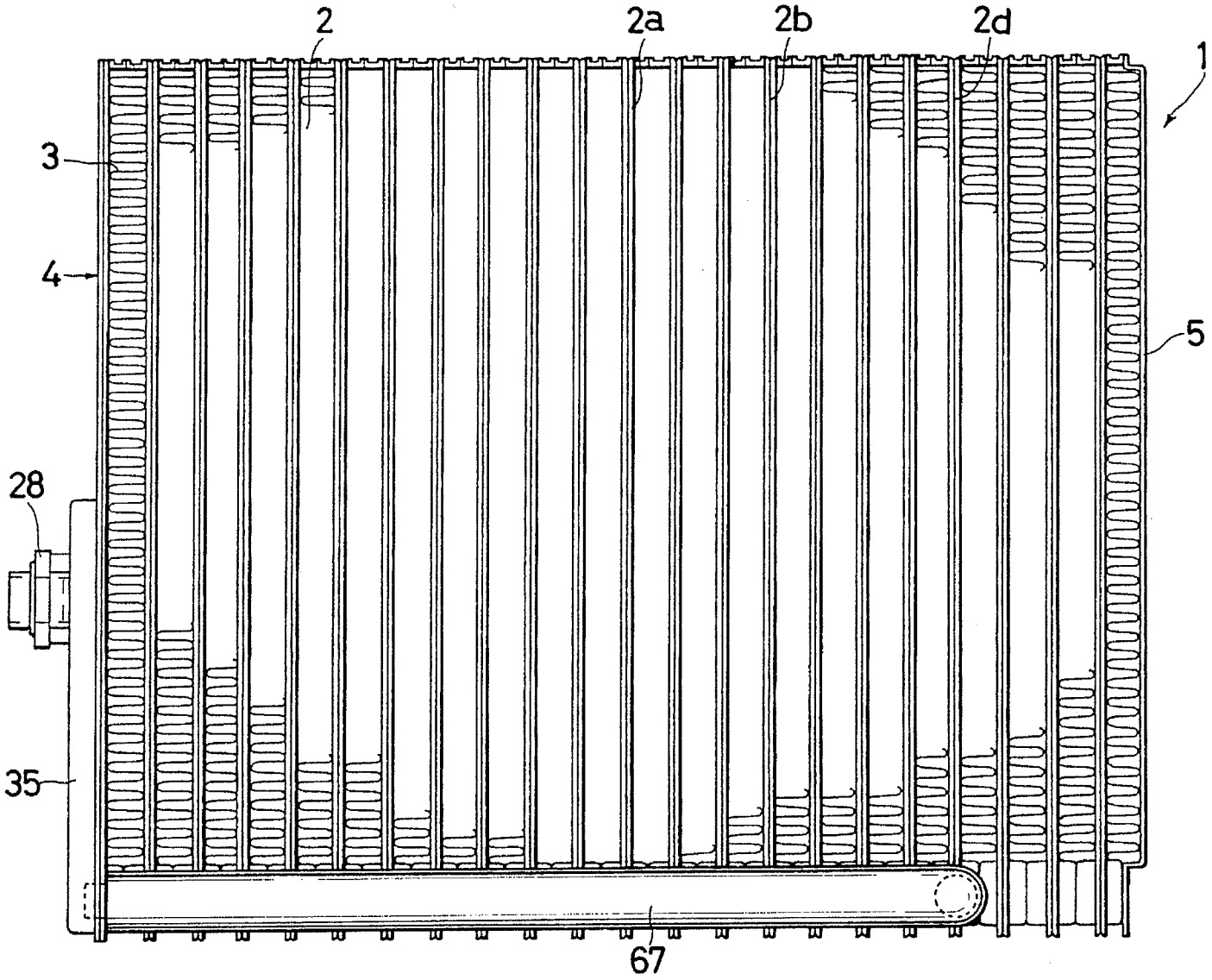
FIG. 8 is a front elevation of a laminated heat exchanger in a third embodiment.
Figure 9:
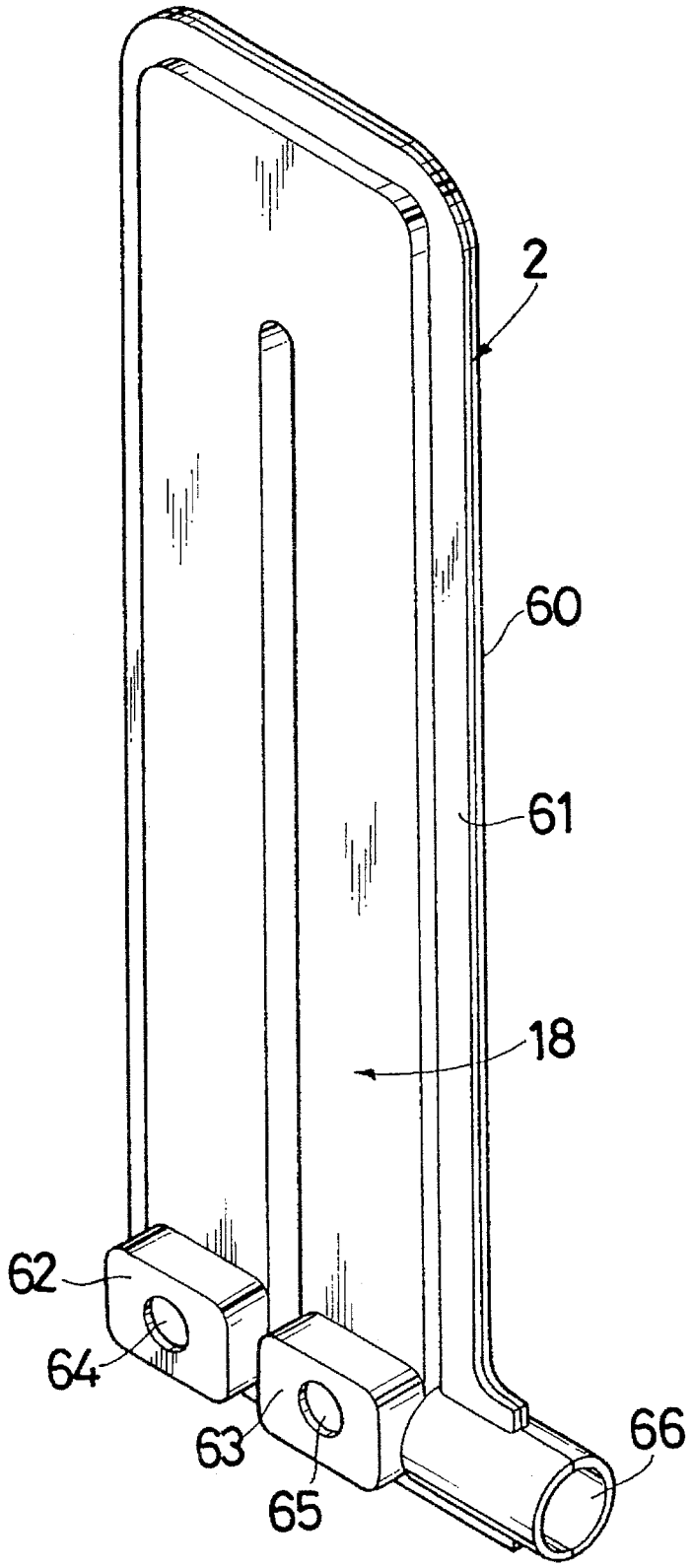
FIG. 9 is a perspective view of a heat exchanging element in a third embodiment, into which the communicating pipe is inserted.
Figure 10:
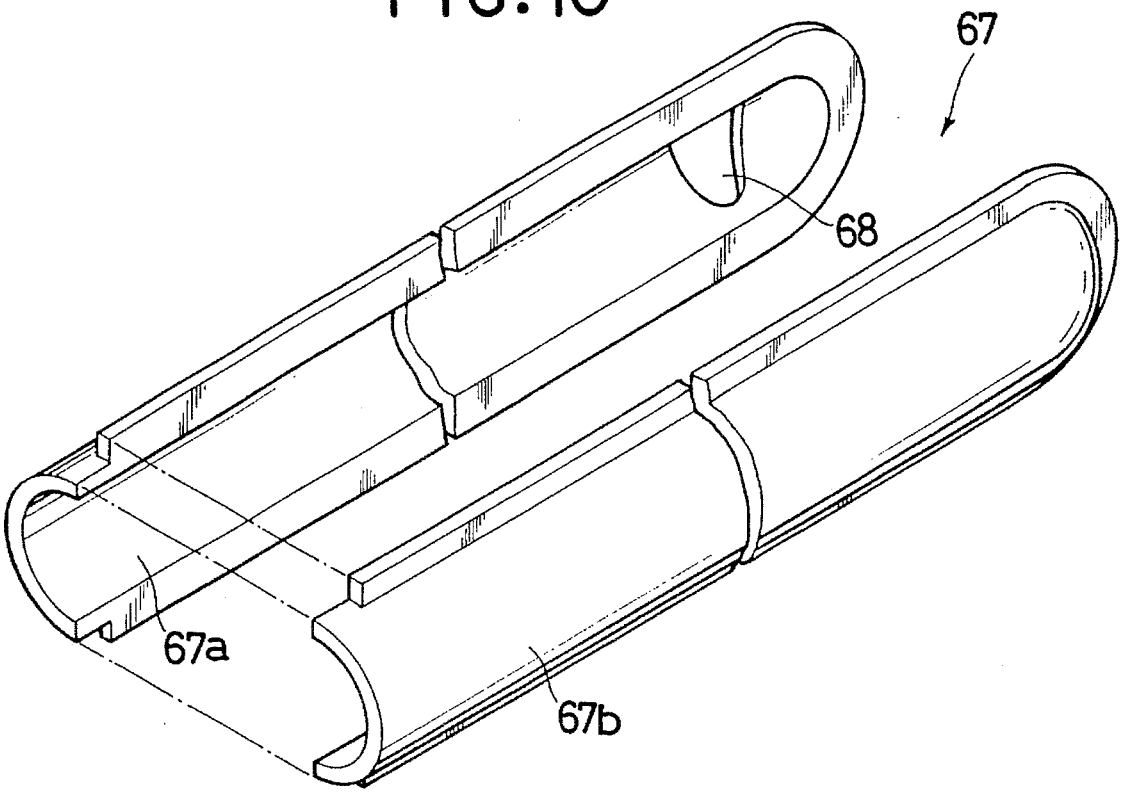
FIG. 10 is a exploded perspective view the communicating pipe in the third embodiment.
Figure 11:
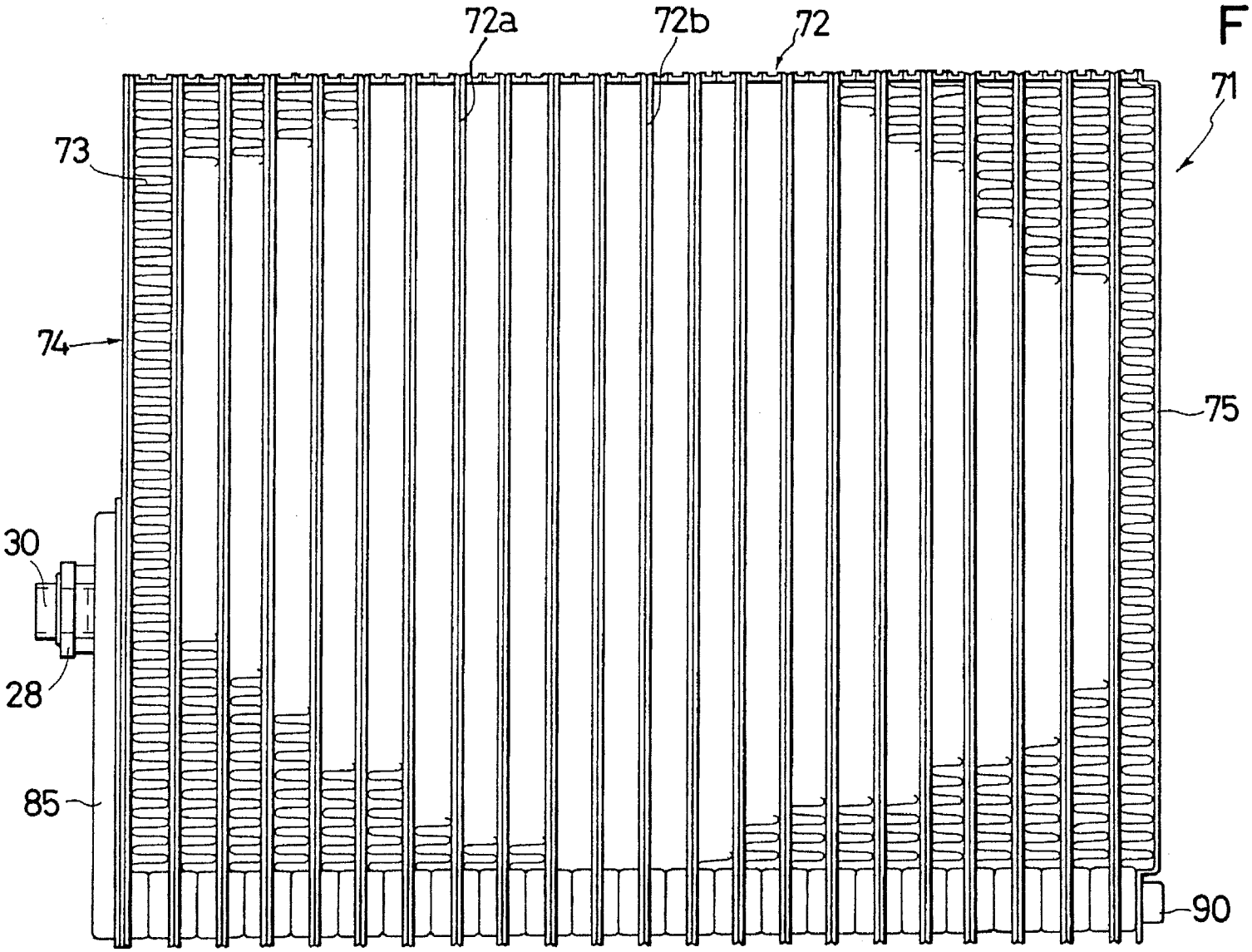
FIG. 11 is a front elevation of a laminated heat exchanger in a fourth embodiment.
Figure 12:
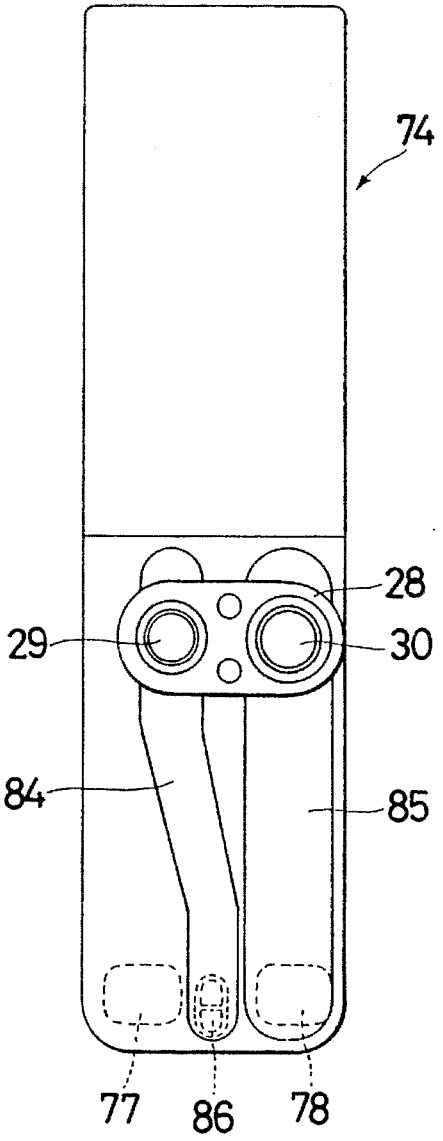
FIG. 12 is a side elevation of the laminated heat exchanger in the fourth embodiment.
Figure 13:
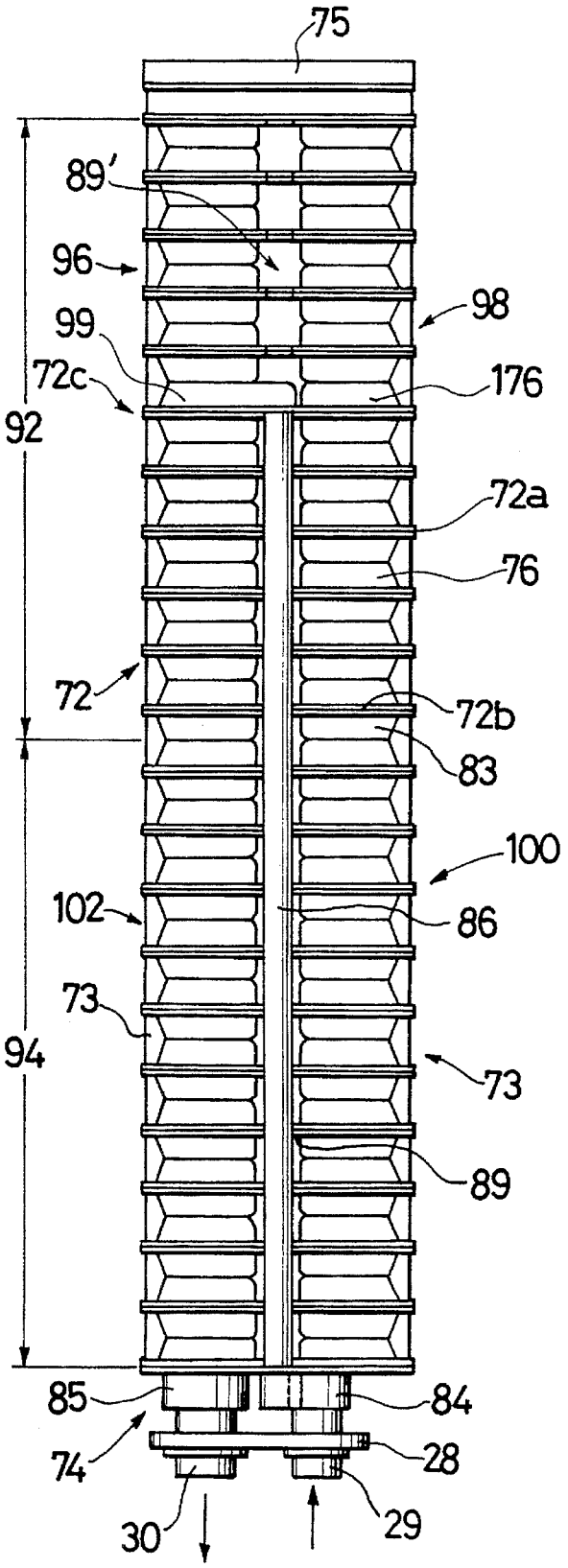
FIG. 13 is a bottom view of the laminated heat exchanger in the fourth embodiment.

The following is an explanation of the laminated heat exchanger 1 in a third embodiment which is shown in FIG. 8–10. Note that the same key numbers are assigned to components identical to those in the first embodiment, and their explanation is omitted.

The heat exchanging element 2*d* in the third embodiment is formed as shown in FIG. 9 by bonding a pair of formed plates 60, 61. With this, tanks 62, 63 are formed and opening portions 64, 65 that communicate between both sides of a tanks 62, 63 are also formed. Also, in the heat exchanging element 2*d*, a coolant outlet port 66 is formed, which extends out to the side from a tank 63.

A communicating pipe 67 communicates between the coolant outlet port 66 and the second coolant passage 35 which is formed in the aforementioned end plate 4. As with the communicating pipe 24 shown in FIG. 6, it is structured with two members, 67*a*, 67*b*, which are two equal portions. The communicating pipe 67 is also provided with an insertion hole 68 into which the aforementioned coolant outlet port 66 is fitted. With the communicating pipe 67 thus structured, an advantage is gained in that the formed plates 60, 61, which are provided with a coolant outlet as employed in a prior art laminated heat exchanger, can be used. Additionally, similar advantages to those achieved in the aforementioned first embodiment are achieved.

A following is an explanation of the laminated heat exchanger in a fourth embodiment which is shown in FIGS. 11–14.

The heat exchanger 71 in this embodiment is a heat exchanger with, for example, four routes and it is assembled by laminating heat exchanging elements 72 and corrugated fins 73 alternately, with end plates 74, 75 provided at both sides in the direction of the lamination and with the whole structure being assembled as a unit in a furnace by brazing.

A heat exchanging element 72 is structured with a heat exchanging element 72*a*that communicates with a adjacent tanks, a heat exchanging element 72*b*, which does not communicate with a tank on one side, and a heat exchanging element 72*c* which is provided with a communicating passage 99.

Figure 14:
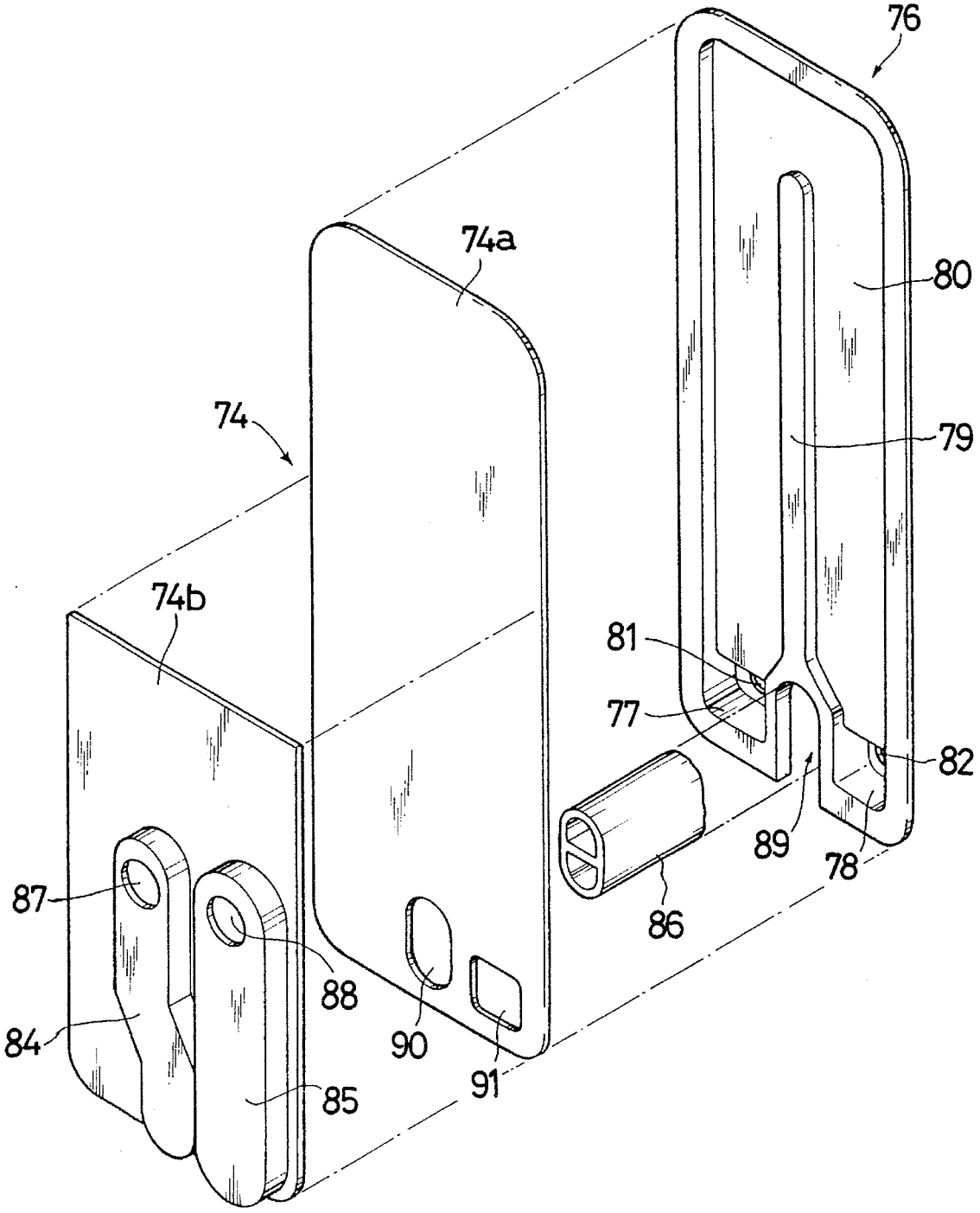
FIG. 14 is an exploded perspective view in an area of an end plate in the fourth embodiment.

The heat exchanging element 72*a*is structured by bonding the formed plates 76 facing each other. The formed plate 76 is provided with two indented portions 77, 78 which are formed by distending the lower portion as shown in FIG. 14, and is provided with an elongated raised member 79 which separates the two indented portions 77, 78 and which extends upwards. On the peripheral edge of the elongated raised member 79, a U-shaped groove 80 that communicates between the aforementioned indented portions 77, 78 is formed. Also, opening portions 81, 82 are formed in the aforementioned indented portions 77, 78, respectively.

The heat exchanging element 72*b* is formed by bonding a aforementioned formed plate 76 and a formed plate 83 facing each other, which are structured identically to each other except that in formed plate 83, only the opening portion on one side, that is, the opening portion 77, is actually open. The whole structure is built thus, so that a tanks on one side communicate with the adjacent tanks, while a tanks on the other side do not communicate with the adjacent tanks.

The heat exchanging element 72*c* is formed by bonding the aforementioned formed plate 76 and a formed plate 176 facing each other. The formed plate 176 is structured identically to a formed plate 76, except that the opening portion 77 on one side is provided with a pipe insertion hole (201 in FIG. 16) into which the communicating passage 99, formed to extend out within a notched portion 89 and one end of the communicating pipe 86 are bonded. With this, the communicating pipe 86 and a tank group 96 communicate via the communicating passage 99.

The aforementioned formed plates 76, 83 are each provided with a notched portion 89, which has a specific length and size, between the two indented portions 77, 78. A plurality of a notched portions 89 are connected continuously to constitute a pipe insertion groove 89' into which a communicating pipe 86 is mounted.

The end plate 74 is structured with the flat plate 74*a* and a intake/outlet passage forming plate 74*b*. The flat plate 74*a* blocks off a formed plate 76 which is positioned at the end, and at the same time, the flat plate 74*a* is provided with a pipe insertion hole 90 for inserting the aforementioned communicating pipe 86, which opens at a position that corresponds with the aforementioned notched portion 89. And coolant discharge outlet 91 opens at a position that faces opposite the aforementioned indented portion 78. In the aforementioned entrance/exit passage forming plate 74*b*, a first coolant passage 85 that communicates between the aforementioned coolant discharge outlet 91 and an outlet hole 88, into which the outlet pipe 30 of the entrance/exit section 28 is mounted, and a second coolant passage 84 that communicates between the opening end of an aforementioned communicating pipe 86 and the intake hole 87, into which the intake pipe 29 of the aforementioned entrance/exit section 28 is mounted, are formed.

In the heat exchanger 71 structured as described above, the coolant which has flowed in from the expansion valve via the intake pipe 29 to a second coolant passage 84 then travels from a second coolant passage 84 to the communicating pipe 86. This communicating pipe 86 is provided in the pipe insertion groove 89' that is formed by continuously aligning the notched portions 89 that are formed at the center at the lower ends of the aforementioned heat exchanging elements 72 and it extends to the communicating passage 99 which is formed in the heat exchanging elements 72*c* of the tank group 96 on the upstream side. The coolant that has passed through the aforementioned communicating pipe 86 then flows into a tank group 96 of a heat exchanging element group 92 via the communicating passage 99 which is formed in the heat exchanging elements 72*c* at the center of a tank group 96. It then passes through the U-shaped passage of the heat exchanging element group 92 and reaches a tank group 98 on the other side.

Since this tank group 98 communicates with a tank group 100 of a heat exchanging element group 94, the coolant then travels to a tank group 100 of a heat exchanging element group 94, and passes through the U-shaped passage of a heat exchanging element group 94 to reach a tank group 102 on the other side. With this, the coolant will have passed through the heat exchanging elements 72 via four routes, while absorbing the heat of the air passing through the fins 73 which are present among the heat exchanging elements 72, and evaporates from a liquid coolant to a gaseous coolant. This gaseous coolant passes through the first coolant passage 85 that is formed in the end plate 74 to reach the outlet pipe 30 and is finally discharged to the next process.

As has been explained so far, in a heat exchanger in a fourth embodiment also, the mounting position of the expansion valve on the end plate 74 can be freely selected by forming the first coolant passage 85 and a second coolant passage 84 in the end plate 74. Also, as the intake pipe can be left out, the advantage of a reduction in the number of components and, consequently, a saving of space can be achieved. Additionally, since the expansion valve is mounted on the end plate, a reduction in ventilation resistance is achieved.

Figure 15:
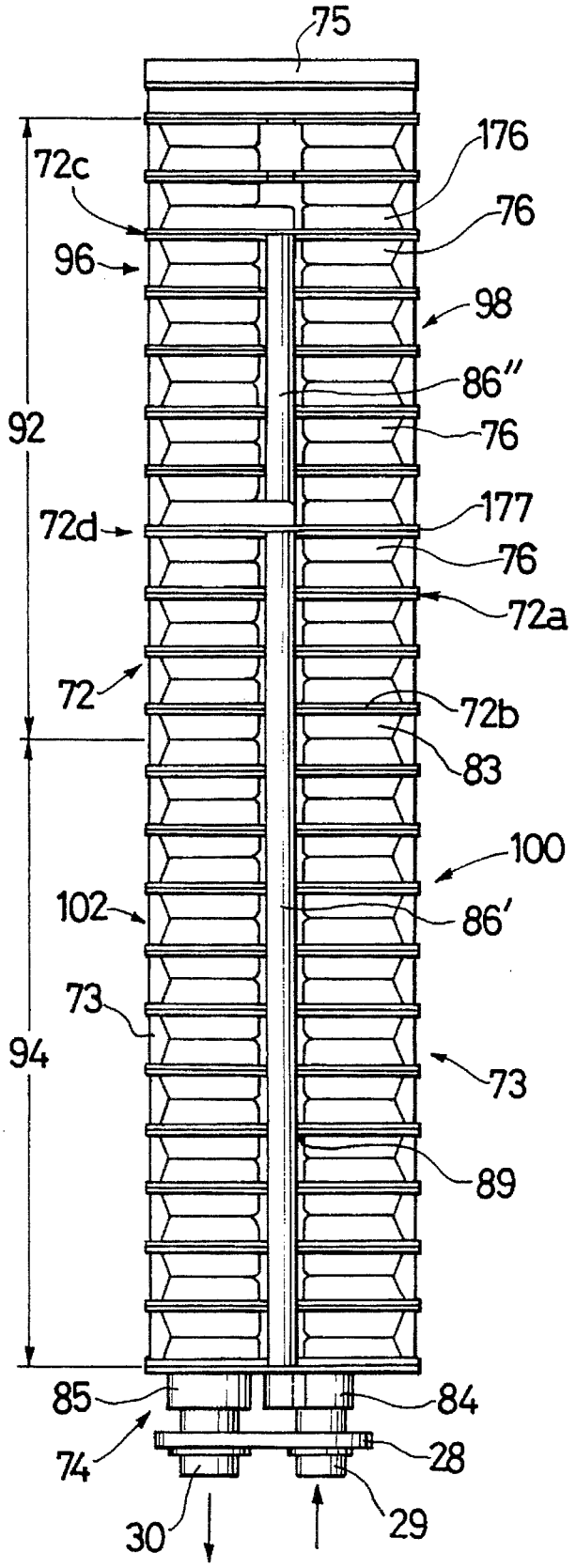
FIG. 15 is a bottom view of an laminated heat exchanger in an fifth embodiment.
Figure 16:
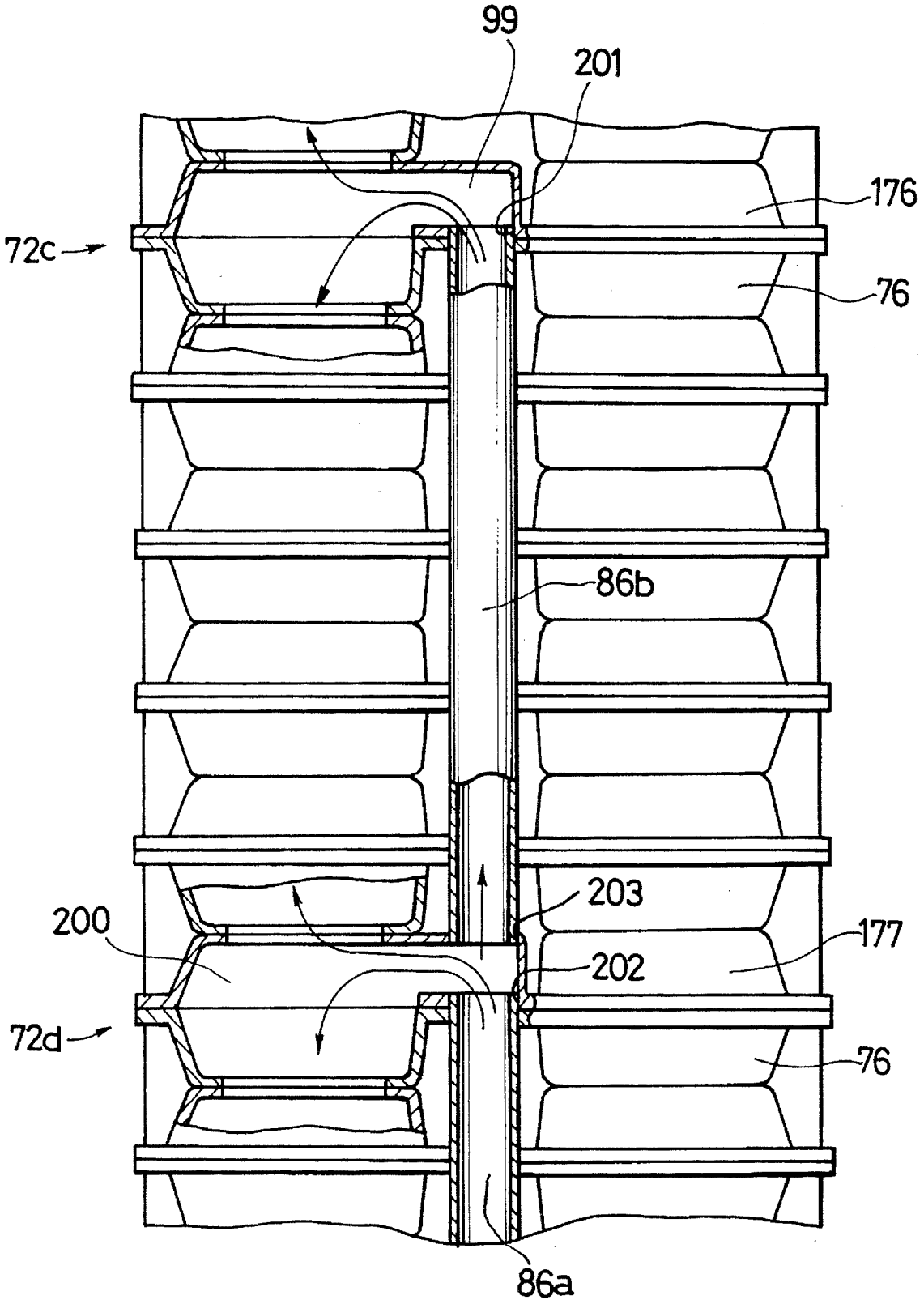
FIG. 16 is an enlarged partial cross section of the laminated heat exchanger in the fifth embodiment.

With a heat exchanger in a fifth embodiment, shown in FIGS. 15 and 16, a heat exchanging element 72 consists of the aforementioned heat exchanging element 72*a*that communicates with the adjacent tank, the aforementioned heat exchanging element 72*b*, which does not communicate with the tank on one side, the aforementioned heat exchanging element 72*c*, which is provided with the communicating passage 99, and a heat exchanging element 72*d*, which is provided with a communicating passage 200. Note that the explanation of a heat exchanging elements 72*a*, 72*b* and 72*c* is identical to that given earlier and is omitted here.

The heat exchanging element 72*d* is structured by bonding a formed plate 76 and a formed plate 177 facing each other. The formed plate 177 in turn is provided with a pipe insertion hole 202 which is formed at the identical position to that of the pipe insertion hole 201 which is formed in the aforementioned formed plate 176, and a pipe insertion hole 203 which is formed at a position that faces opposite the pipe insertion hole 202 and communicates between the pipe insertion hole (first pipe insertion hole) 90, which is formed in the aforementioned end plate 74*a*, and the pipe insertion hole 202 with the communicating pipe (first communicating pip) 86*a*. It also communicates between the pipe insertion hole 203 and the pipe insertion hole 201, which is formed in a heat exchanging element 72*c* with the second communicating pipe 86*b*.

With this structure, a heat exchanging elements 72*c* and 72*d* are positioned at locations that are not adjacent to each other in a heat exchanging element group 92, and the coolant which has flowed into the communicating pipe 86 (86*a*, 86*b*) via the aforementioned second coolant passage 84 then flows into a tank group 96 through two routes, that is, via the first and a second communicating passages 99 and 200. As a result, the passage resistance of the coolant that flows into a heat exchanging element group 92 can be reduced and the temperature distribution of a heat exchanging elements can be made more consistent, thus achieving an improvement in heat exchanging efficiency.

Figure 17:
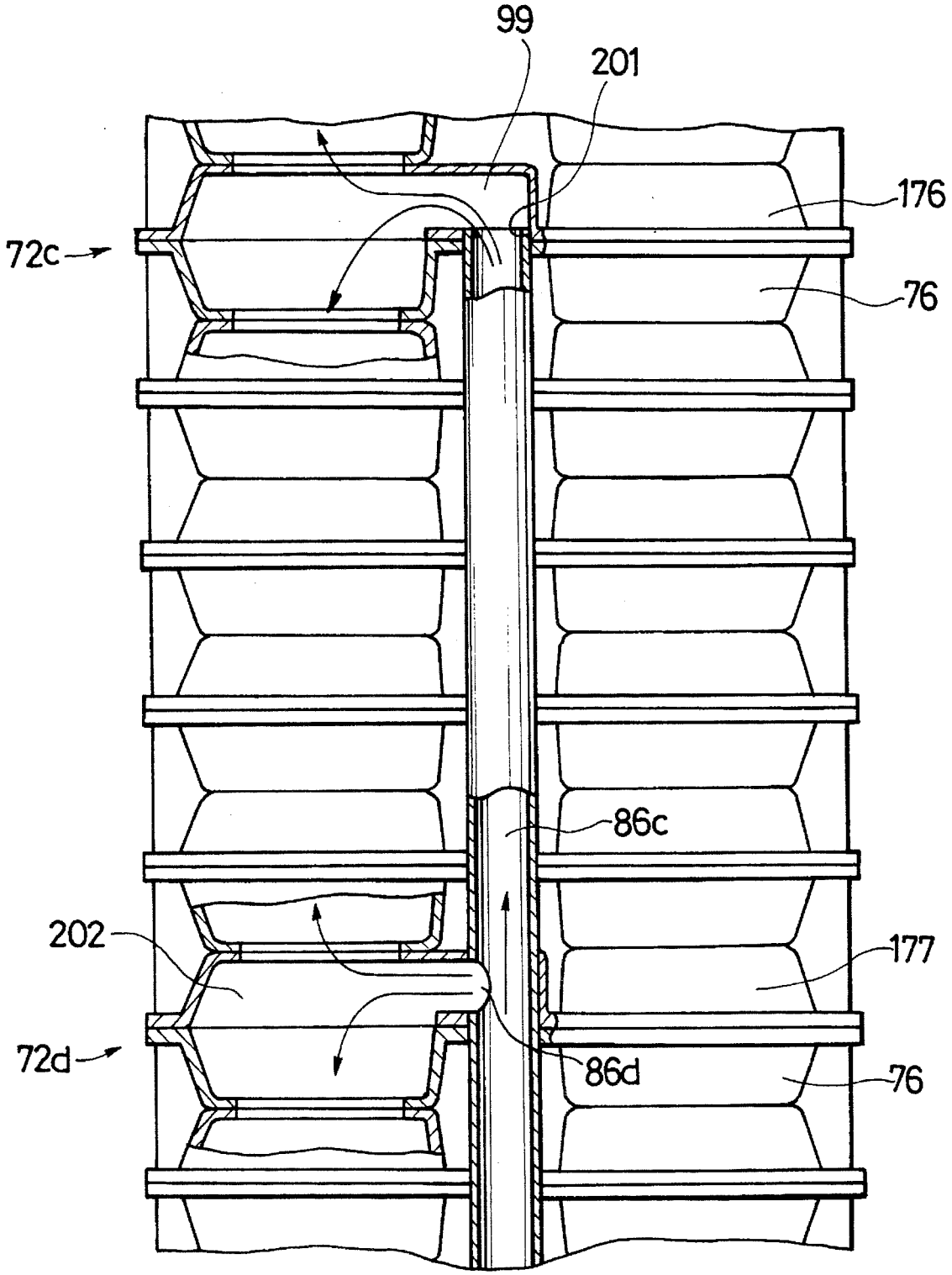
FIG. 17 is an enlarged partial cross section of the laminated heat exchanger featuring another communicating pipe in the fifth embodiment.

Note that while in the fifth embodiment described above, the communicating pipe that communicates between the first pipe insertion hole 90 and the aforementioned heat exchanging elements 72*c*, 72*d* are divided into two portions, 86*a* and 86*b*, the first pipe insertion hole 90 and the aforementioned heat exchanging element 72*c* may communicate via the communicating pipe 86*c* by passing through the aforementioned heat exchanging element 72*d* as shown in FIG. 17, with an opening portion 86*d* formed in area that faces the aforementioned second communicating passage 200 to allow a portion of the coolant to flow through a second communicating passage 200 from this opening portion 86*d*.

Figure 18:
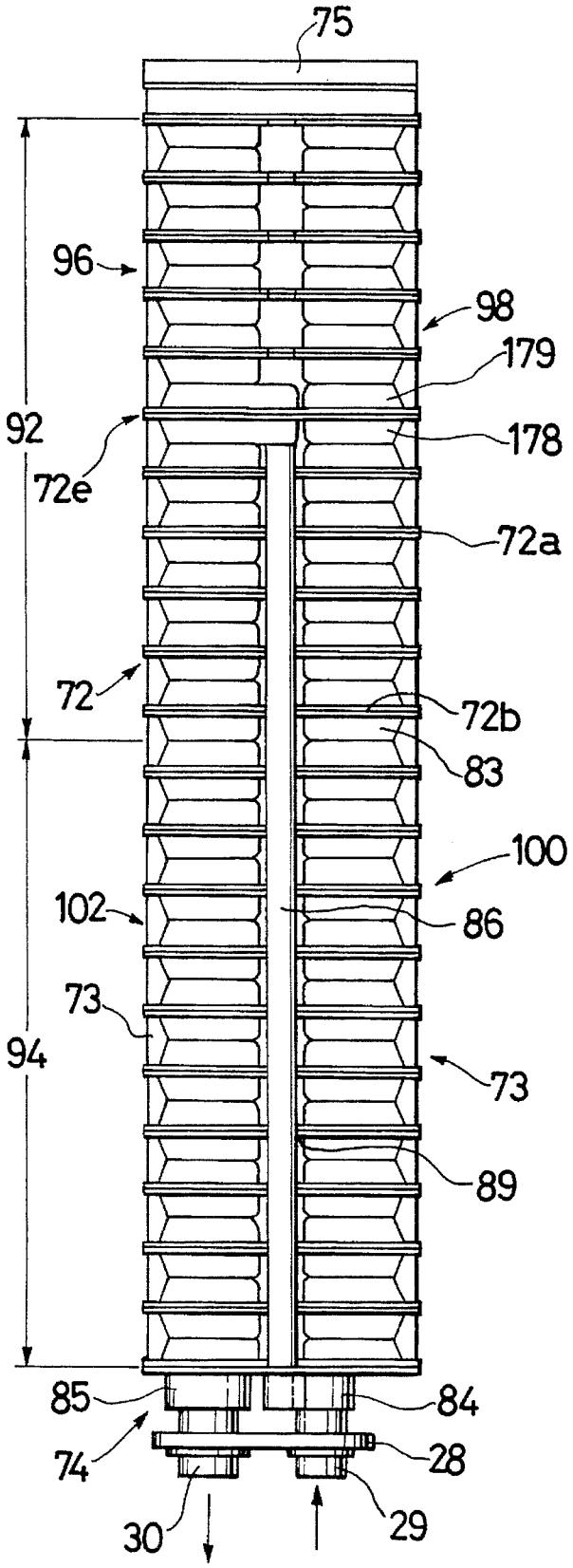
FIG. 18 is a bottom view of an laminated heat exchanger in an sixth embodiment.
Figure 19:
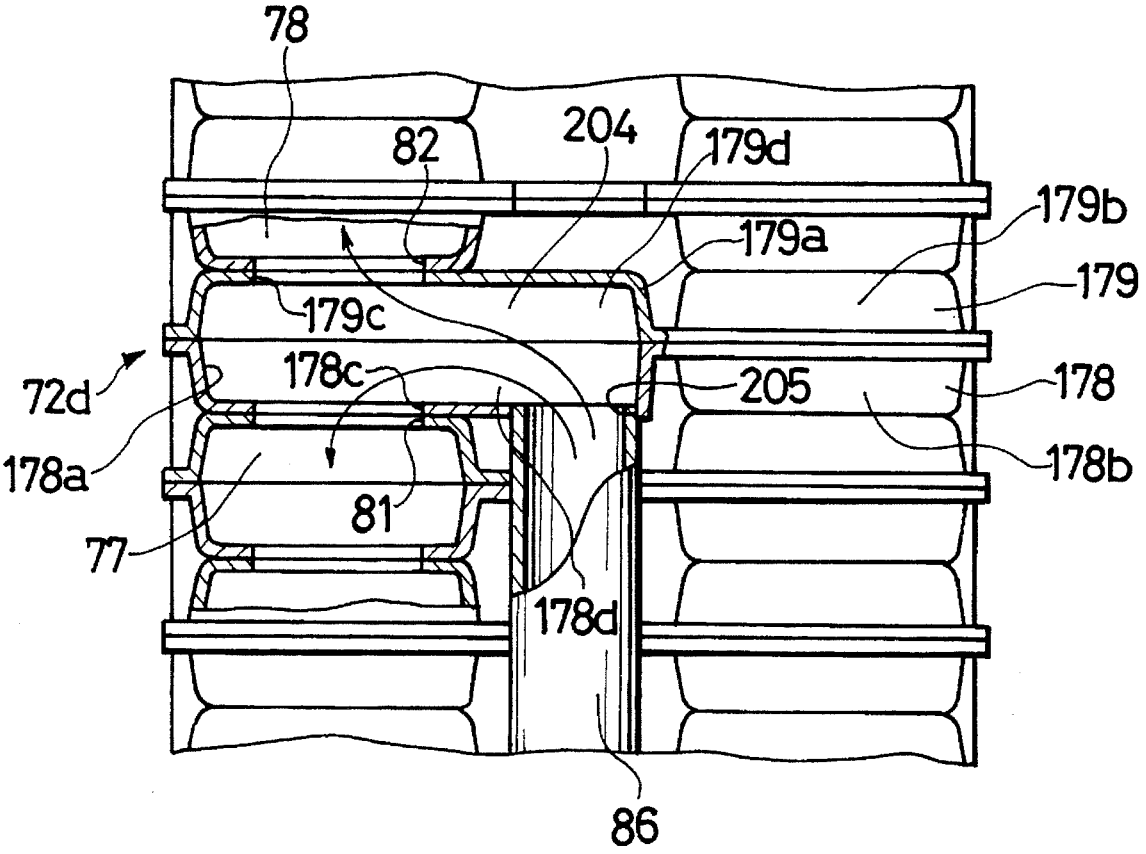
FIG. 19 is an enlarged partial cross section of an laminated heat exchanger in the sixth embodiment.

With a heat exchanger in a sixth embodiment, shown in FIGS. 18 and 19, a heat exchanging element 72 consists of the aforementioned heat exchanging element 72*a*that communicates with the adjacent tanks, the aforementioned heat exchanging element 72*b* which does not communicate with a tank on one side, and a heat exchanging element 72*e* which is provided with a communicating passage 204. Note that the explanation of a heat exchanging elements 72*a*, 72*b* is identical to that given earlier and is omitted here.

The heat exchanging element 72*e* is formed by bonding a formed plate 178 and a formed plate 179 facing each other. The formed plate 178 is provided with two indented portions 178*a* and 178*b* which are formed by distending the lower portion (since they have the same structure as that of the aforementioned indented portion 77, their explanation is omitted) and the indented portion 178*a* is provided with an opening portion 178*c* that communicates with the opening portion 81 that is formed in the indented portion 77 of the aforementioned formed plate 76. A pipe insertion hole 205 which is located at an area 178*d* (communicating passage forming portion) formed by extending out towards the center.

Also, a formed plate 179 is provided with two indented portions 179*a* and 179*b* which are formed by distending the aforementioned lower portion (since they have the same structure as that of the aforementioned indented portion 78, their explanation is omitted) and the indented portion 179*a* is provided with an opening portion 179*c* which communicates with the opening portion 82 that is formed in the indented portion 78 of the aforementioned formed plate 76. A communicating passage forming portion 179*d* is formed by extending out towards the center and forms a communicating passage 204 by being bonded facing opposite the aforementioned communicating passage forming portion 178*d*.

In the sixth embodiment, which is structured as described above, since the passage resistance in the communicating passage can be reduced with an increase in the volumetric capacity of the communicating passage, the flow of coolant becomes smoother, resulting in an improvement in the efficiency with which heat exchanging is performed.

Figure 20:
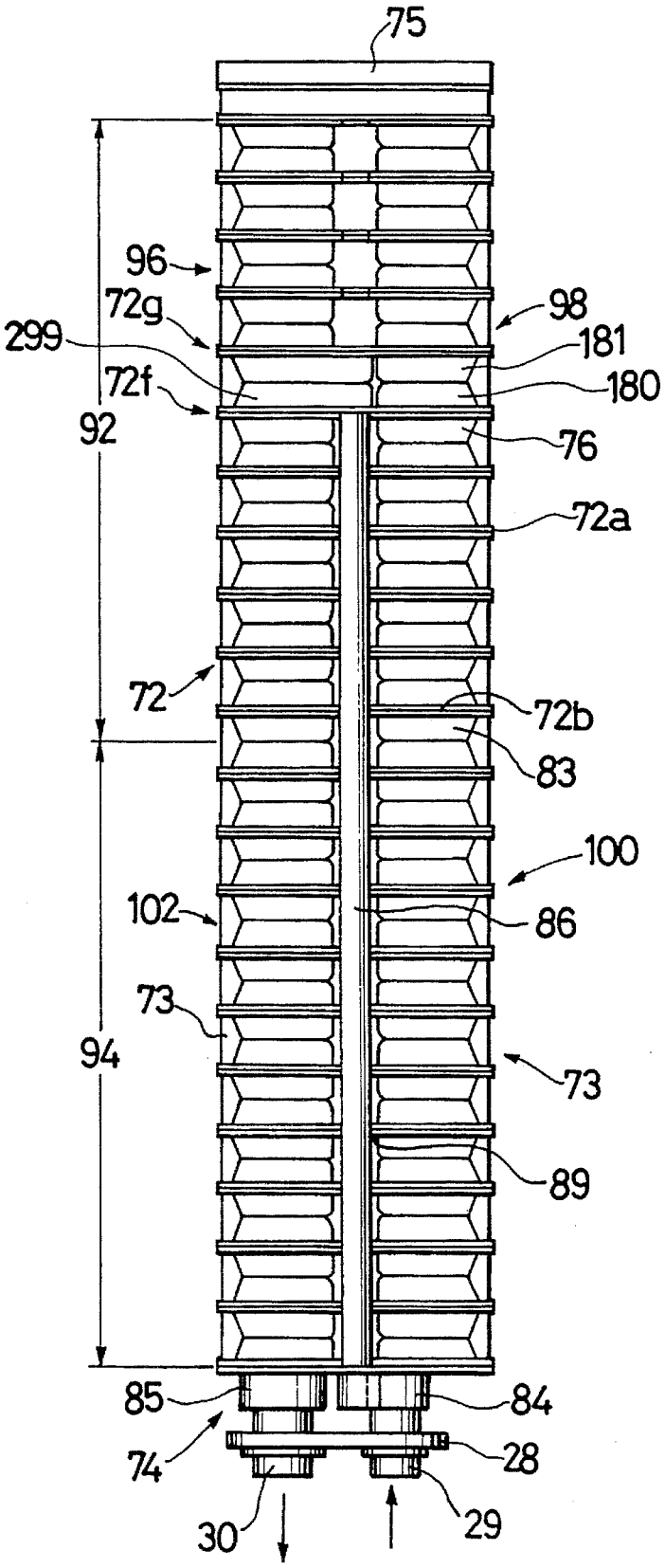
FIG. 20 is a bottom view of the laminated heat exchanger in an seventh embodiment.
Figure 21:
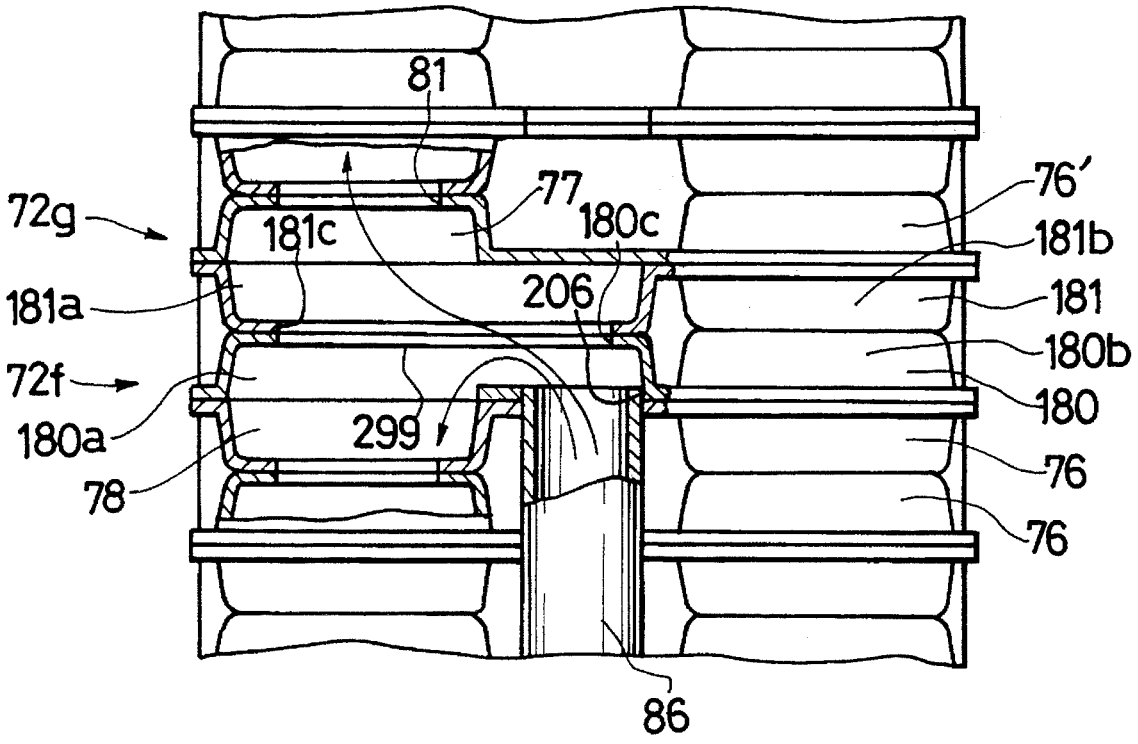
FIG. 21 is an enlarged partial cross section of an laminated heat exchanger in the seventh embodiment.

With a heat exchanger in a seventh embodiment, shown in FIGS. 20 and 21, a heat exchanging element 72 consists of the aforementioned heat exchanging element 72*a*that communicates with the adjacent tanks, the aforementioned heat exchanging element 72*b* which does not communicate with a tank on one side, and heat exchanging elements 72*f* and 72*g* that constitute a communicating passage 299. Note that the explanation of a heat exchanging elements 72*a*, 72*b* is identical to that given earlier and is omitted here.

The heat exchanging element 72*f* is formed by bonding a formed plate 76 and a formed plate 180 facing each other. The formed plate 180 is provided with two indented portions 180*a*, 180*b* (since they are structured identically to the aforementioned indented portion 78 their explanation is omitted) which are formed by distending the lower portion. The indented portion 180*a* is bonded facing opposite the indented portion 78 of the aforementioned formed plate 76. It is also provided with a pipe insertion hole 206 in the section formed by extending out toward the center. It also has an opening portion 180*c* in the dorsal area of the indented portion 180*a*.

The heat exchanging element 72*g* is formed by bonding a formed plate 76' and a formed plate 181 facing each other.

The formed plate 181 is provided with two indented portions 181*a*, 181*b* (since they are structured identically to the aforementioned indented portions 77 their explanation is omitted) which are formed by distending the lower portion, and the indented portion 181*a* is bonded facing opposite the indented portion 77 of the aforementioned formed plate 76' in such a manner that the area that faces the notched portion 89 in the area formed by extending out toward the center is blocked off by a formed plate 76'. Also in the dorsal surface of the indented portion 181*a*, an opening portion 181*c* which is bonded with the opening portion 180*c* formed in the aforementioned formed plate 180 is formed.

By bonding a heat exchanging elements 72*f* and 72*g*, which are structured as described above, the communicating passage 299 is formed to achieve similar effects to those achieved by the aforementioned sixth embodiment.

Figure 22:
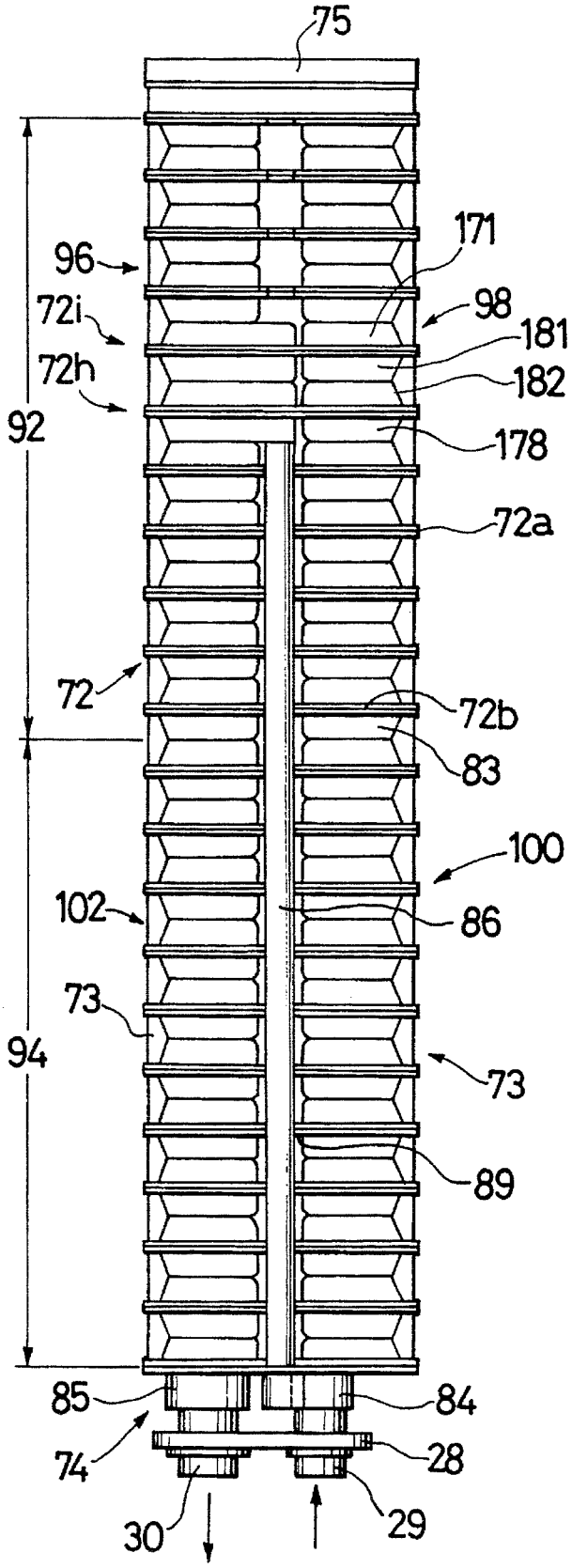
FIG. 22 is a bottom view of the laminated heat exchanger in an eighth embodiment.
Figure 23:
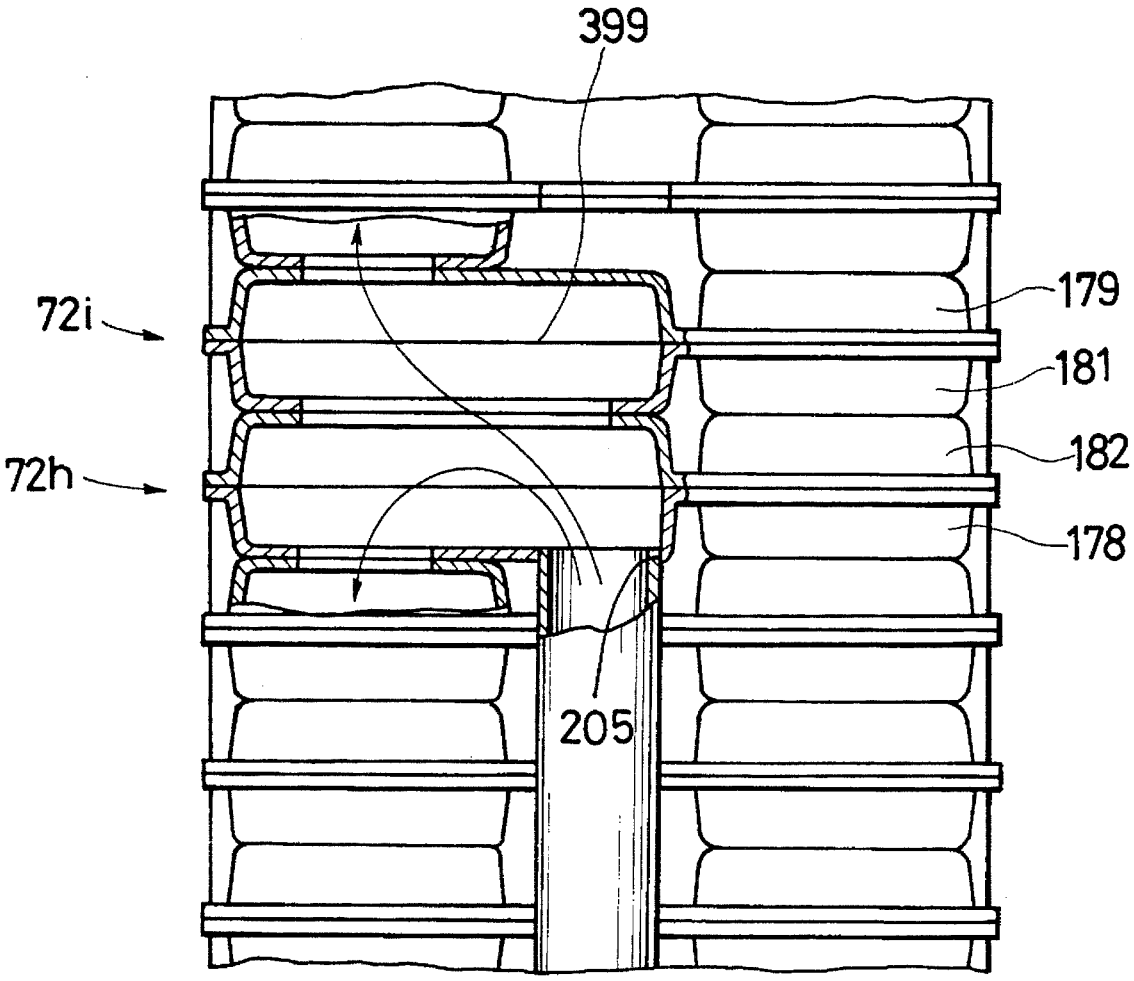
FIG. 23 is an enlarged partial cross section of an laminated heat exchanger in the eighth embodiment.

With a heat exchanger in a eighth embodiment, shown in FIGS. 22 and 23, a heat exchanging element 72 consists of the aforementioned heat exchanging element 72*a*, which communicates with the adjacent tanks, the aforementioned heat exchanging element 72*b*, which does not communicate with a tank on one side, and heat exchanging elements 72*h* and 72*i* that constitute a communicating passage 399. Note that explanation of a heat exchanging elements 72*a*, 72*b* is identical to that given earlier and is omitted here.

The heat exchanging element 72*h* is formed by bonding a formed plate 178 and a formed plate 182 facing each other and a heat exchanging element 72*i* is formed with a formed plate 181 and a formed plate 179, with a formed plate 182 shaped symmetrical to the shape of the aforementioned formed plate 181. Because of this, by bonding a heat exchanging elements 72*h* and a heat exchanging elements 72*i*, the volumetric capacity of the communicating passage 399 is increased even more than in a heat exchangers in the sixth and seventh embodiments described above, thus reducing even further the passage resistance in comparison to those embodiments.

Figure 24:
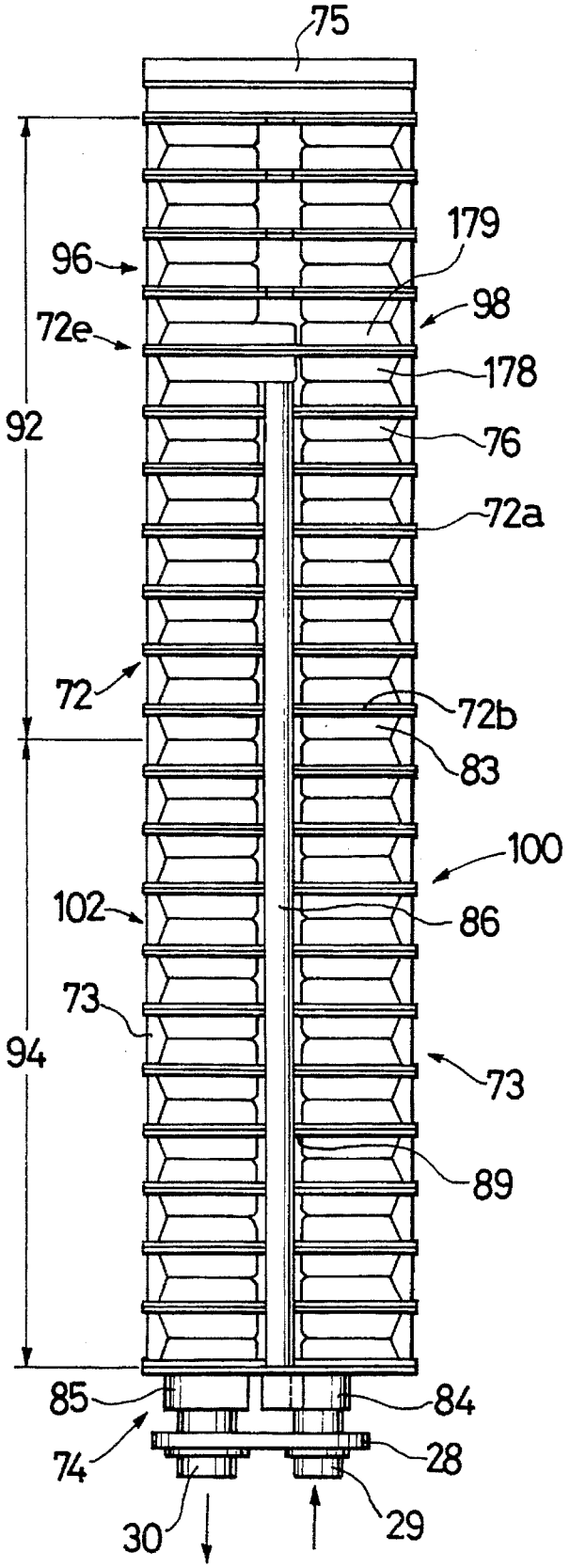
FIG. 24 is a bottom view of the laminated heat exchanger in an ninth embodiment.
Figure 25:
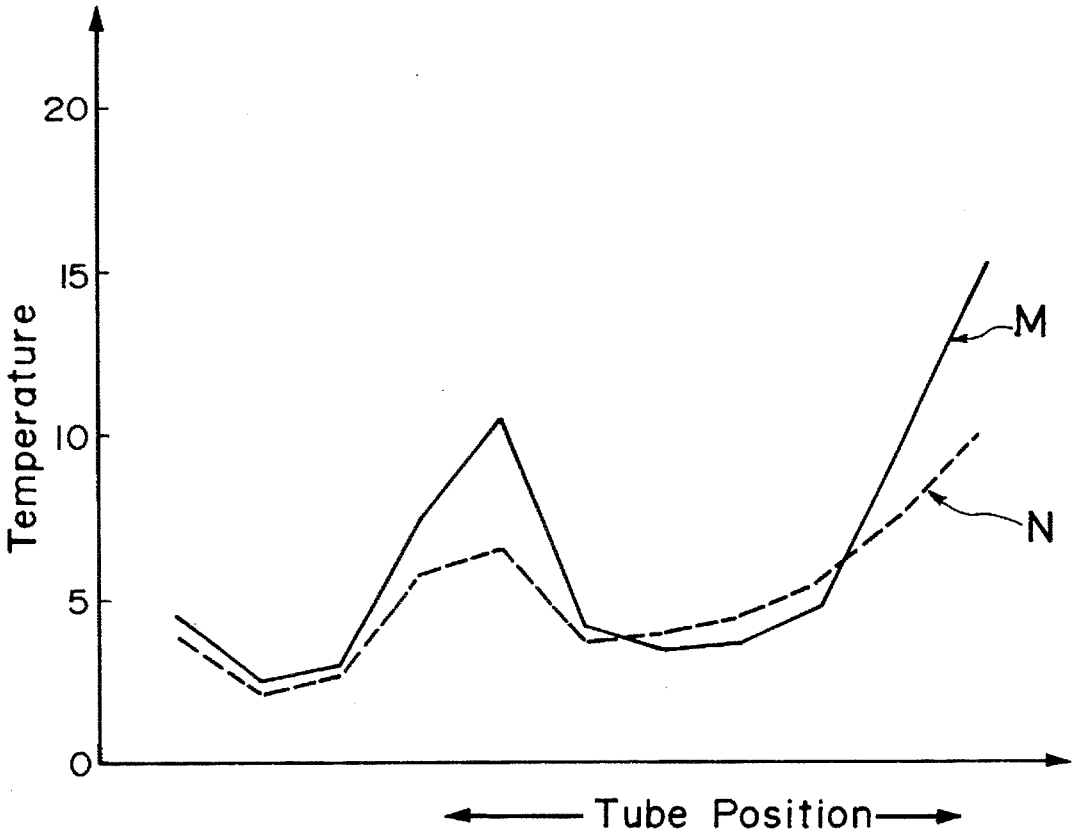
FIG. 25 is an explanatory diagram showing an temperature distribution of an laminated heat exchanger in an ninth embodiment.
Figure 25:
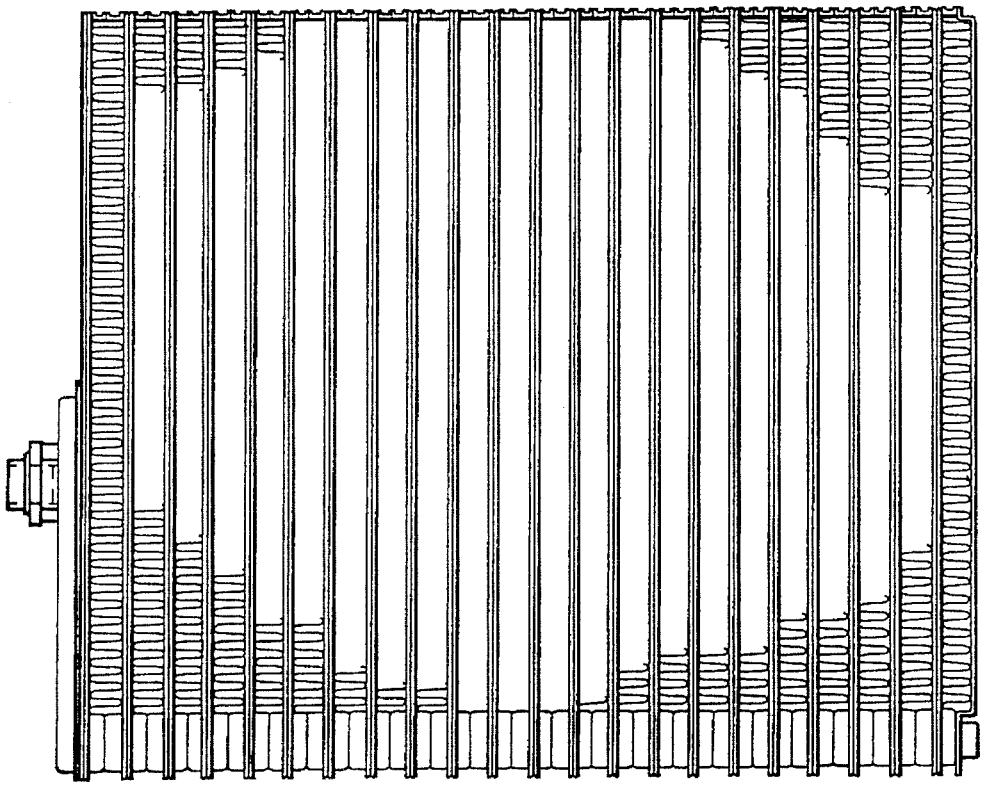

A heat exchanger in a ninth embodiment that is shown in FIG. 24 is identical to a heat exchanger in the sixth embodiment described earlier, except that the position of the heat exchanging element 72*e* is moved toward the outside by a specific distance from the center of a heat exchanging element group 92. With this, the quantity of coolant that, after flowing out of the communicating pipe and deflecting off the opposing surface, flows toward the inside of the tank group from the communicating passage and the quantity of coolant that flows toward the outside of a tank group can be made uniform. As a result, the temperature distribution of a heat exchanging element group 92 is more uniform, as shown by N in FIG. 25, compared with the temperature distribution shown by M in the same figure, achieving an improvement in efficiency with which a heat exchanger performs heat exchanging.

Figure 26A:
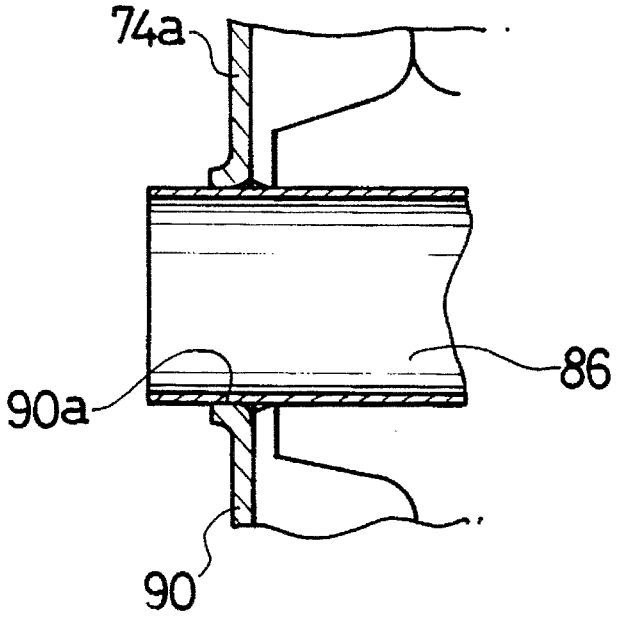
FIG. 26 (*a*) is a partial cross section illustrating a bonding of the communicating pipe and a first pipe insertion hole.
Figure 26B:
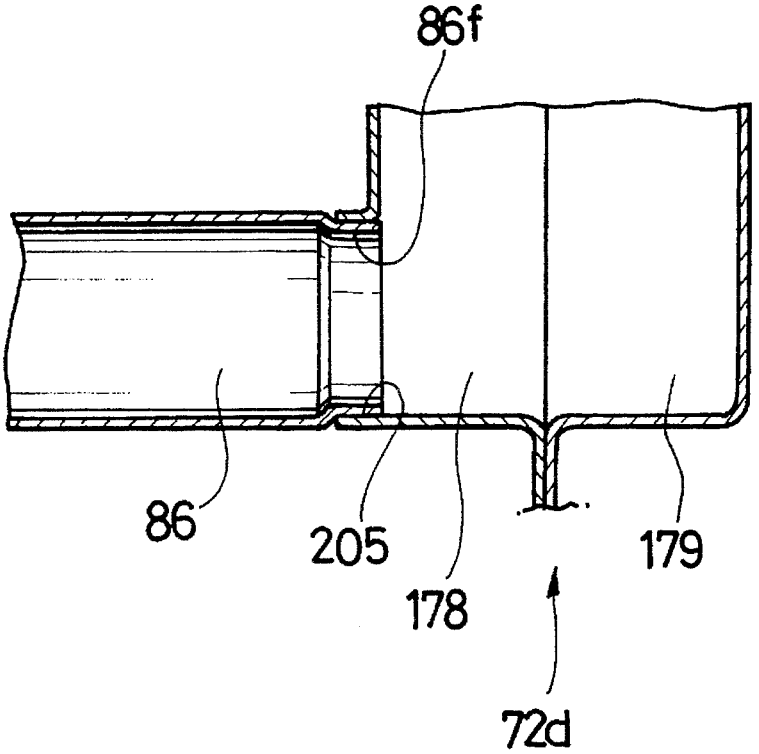

The embodiment shown in FIGS. 26A and 26B shows the bonding state of the communicating pipe, and to refer to the heat exchanger of the fourth embodiment, shown in FIGS. 18 and 19 as an explanatory example, FIG. 26*a* shows the bonding state between one end of the aforementioned communicating pipe 86 and the first pipe insertion hole 90. FIG. 26B shows the bonding state between the other end of the aforementioned communicating pipe 86 and a second pipe insertion hole 205. In this example, a flange for insertion 90*a* is formed around the aforementioned first pipe insertion hole 90, and by brazing the internal circumferential surface of the flange for insertion 90*a* to the external circumference at one end of the aforementioned communicating pipe 86, they are bonded.

FIG. 26B shows the state in which the other end of the communicating pipe 86 is bonded to a heat exchanging element 72*e* . In this figure, a small diameter portion 86*f*, which is formed at the end of the communicating pipe 86, is inserted into a second pipe insertion hole 205, which is formed in a formed plate 178. The aforementioned other end of the communicating pipe 86 is bonded by brazing the external circumference of the small diameter portion 86*f* together with the internal circumference of the aforementioned second pipe insertion hole 205.

Figure 27A:
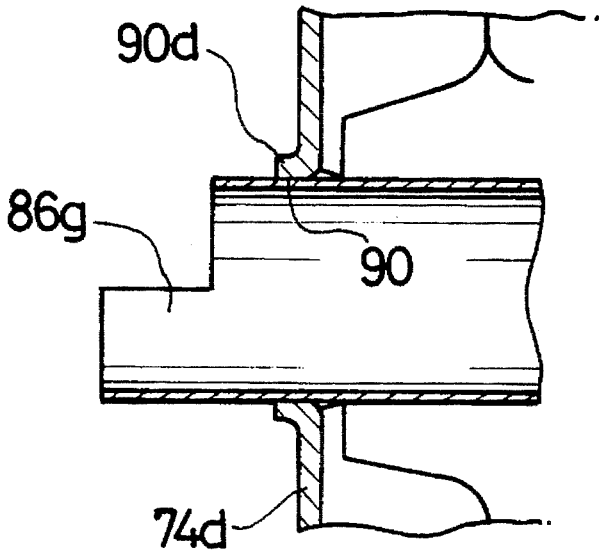
FIG. 27 (*a*) is a partial cross section showing an end plate side.
Figure 27B:
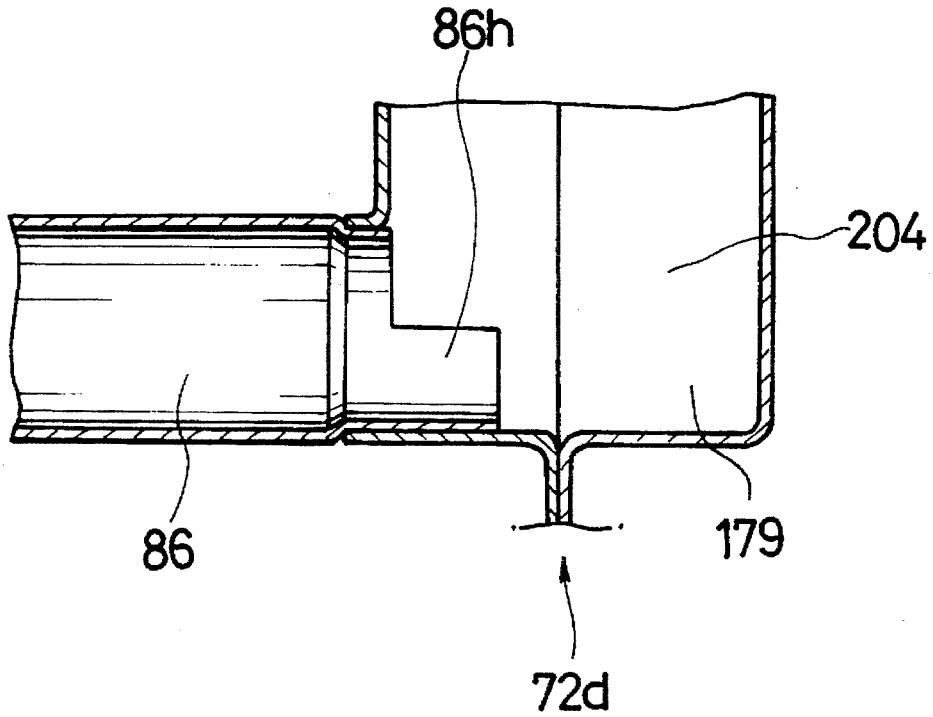

The embodiment shown in FIGS. 27A and B, is provided with guides 86*g*, 86*h* at the ends of the aforementioned communicating pipe 86 in order to reduce the passage resistance of the coolant. This enables the coolant to flow smoothly from a second communicating passage 84 into the communicating pipe 86 and from the communicating pipe 86 into the communicating passage 204, resulting in a reduction in passage resistance.

In a heat exchangers presented in the nine embodiments described above, the explanation is based on a fixed flow of the coolant in a specific direction. However, in heat exchangers in which the coolant flows in the opposite direction, similar advantages are achieved and therefore the invention does not restrict the flow direction of the coolant.

As has been explained so far, with the present invention, by forming a first coolant passage that communicates with one end of the coolant path and a second coolant passage that communicates with the other end of the coolant path in one of the end plates and by changing the form of these paths, the width and position of the entrance/exit section that connects with the expansion valve can be freely changed, enabling the mounting of the expansion valve at an optimal position.

Also, by having a second coolant passage communicate with a tank group that constitutes the end of the coolant path via the communicating pipe, even in heat exchangers with varying number of routes and different directions of passage, it is possible to locate the entrance/exit section on one of the end plates, making it possible to mount the expansion valve at a specific position.

Furthermore, by structuring the communicating passage that communicates between the communicating pipe and the tank group that constitutes the end of the coolant path with a plurality of formed plates, the passage resistance can be reduced when the coolant flows in and out between the communicating pipe and a heat exchanging elements, achieving an improvement in the efficiency with which heat exchange is performed.

What is claimed is:

1. A heat exchanger, comprising:

a laminated assembly comprising a plurality of laminated heat exchanging elements laminated alternately with corrugated fins, each of said plurality of laminated heat exchanging elements comprising formed plates bonded so as to face each other and defining therebetween a pair of tanks and a U-shaped passage communicating said pair of tanks with each other, said laminated assembly having opposite ends;

a pair of end plates provided on said opposite ends of said laminated assembly, one of said end plates comprising a pipe insertion hole;

wherein said heat exchanging elements are laminated in a direction of lamination and said laminated assembly has one side on which one of said tanks of each said pair of tanks is located and an other side on which the other of said tanks of each said pair of tanks is located;

a coolant path defined by said tanks and said U-shaped passages, wherein said coolant path comprises a plurality of adjacent said tanks on one side of said laminated assembly being in fluid communication with each other, said tanks on the one side also being partitioned at at least one position, whereby a plurality of tank groups on the one side are defined, wherein said coolant path further comprises a plurality of adjacent said tanks on the other side of said laminated assembly being in fluid communication with each other, and said tanks on the other side also being partitioned at at least one position, whereby a plurality of tank groups on the other side are defined, and wherein said coolant path further comprises a plurality of layers of coolant routes defined by said plurality of tank groups on the sides of said laminated assembly and said U-shaped passages, wherein each of said layers of coolant routes comprises one of said tank groups on one side of said laminated assembly, one of said tank groups on the other side of said laminated assembly, and said U-shaped passages connecting said tanks of said one of said tank groups on the one side of said laminated assembly to said tanks of said one of said tank groups on the other side of said laminated assembly, wherein some of said tank groups located adjacent to each other in said direction of lamination are in fluid communication such that said plurality of layers of coolant routes are fluidly connected in series;

an entrance/exit section having a fluid entrance side and a fluid exit side;

an intake/out,let passage forming plate bonded onto said one of said end plates, said intake/outlet passage forming plate comprising a plate having a first coolant passage formed therein communicating one end of said coolant path with one of said sides of said entrance/exit section and a second coolant passage communicating the other side of said entrance/exit section with said pipe insertion hole; and a communicating pipe having one end bonded to said pipe insertion hole for communication with said second coolant passage and an other end communicating with the other end of said coolant path.

2. The heat exchanger of claim 1, wherein:

said intake/outlet passage forming plate comprises a single one-piece plate having a first indented portion therein defining said first coolant passage and a second indented portion therein defining said second coolant passage.

3. The heat exchanger of claim 1, wherein:

said one of said end plates further comprises a coolant flow hole therein fluidly communicating one of said tank groups on one side of said laminated assembly with said first coolant passage, whereby said first coolant passage is communicated with the one end of said coolant path; and said one of said end plates further closes off fluid communication between another of said tank groups on the other side of said laminated assembly and said second coolant passage.

4. The heat exchanger of claim 1, wherein said first and second coolant passages extend along said intake/outlet passage forming plate in a direction perpendicular to said direction of lamination from a point where said first coolant passage communicates with the one end of said coolant path and said second coolant passage communicates with said pipe insertion hole, respectively, to a separate point on said intake/outlet passage forming plate where said first and second coolant passages have respective fluid holes in communication with respective said sides of said entrance/exit section.

5. The heat exchanger according to claim 1, wherein:

said communicating pipe communicates with said pipe insertion hole as formed in an extended portion that extends out to the side from a lower portion of said end plate and said intake/outlet passage forming plate, and has another end inserted into a second pipe insertion hole in a communicating passage formed by a specific said tank extending outwardly in said tank group at the other end of said coolant path to communicate with said other end of said coolant path.

6. The heat exchanger according to claim 5 wherein:

in said coolant path, a tank group that communicates with said first coolant passage is upstream and a tank group that communicates with said communicating pipe is downstream.

7. The heat exchanger according to claim 5 wherein:

said communicating pipe is formed by bonding semicylindrical plates facing each other.

8. The heat exchanger according to claim 5, wherein said communicating pipe is formed by bonding a semicylindrical plate facing a plate in which an insertion hole for inserting an extended pipe formed by extending from said tank at said specific position.

9. The heat exchanger according to claim 1 wherein:

one end of said communicating pipe communicates with said pipe insertion hole formed in an extended portion that extends out to the side from a lower portion of said end plate and said intake/outlet passage forming plate, and the other end communicates with a pipe insertion hole which is formed in an extended portion that extends toward the side from a plurality of tanks which do not lie adjacent to one another in a tank group at the other end of said coolant path.

10. The heat exchanger according to claim 9 wherein:

said communicating pipe comprises:

a first communicating pipe that communicates between a pipe insertion hole that is formed in said one of said end plates and a pipe insertion hole formed in said extended portion that is at the closest to said pipe insertion hole, and a second communicating pipe that communicates between said extended portion and the next extended portion.

11. The heat exchanger according to claim 9 wherein:

said communicating pipe communicates between said pipe insertion hole formed in said one of said end plates and a pipe insertion hole which passes through the extended portion positioned between said pipe insertion hole and the extended portion the farthest from said pipe insertion hole and which is formed in said farthest extended portion, and said communicating pipe is provided with an opening portion that opens into the extended portion where the hole passes through.

12. The heat exchanger according to claim 1 wherein:

said communicating pipe is provided in a pipe insertion groove which is formed between said tank groups on one side and said tank groups on the other side, one end of said communicating pipe communicates with said pipe insertion hole formed at the bottom center of said end plate and said intake/outlet passage forming plate that is bonded onto said end plate and which communicates with said second coolant passage, and the other end of said communicating pipe communicates with a second pipe insertion hole that is formed at the bottom center of the other one of said end plates with a bypass provided that communicates between said second pipe insertion hole and the end of a tank group constituting the other end of said coolant path provided in said other end plate.

13. The heat exchanger according to claim 1 wherein:

said communicating pipe is provided in a pipe insertion groove which is formed between said tank groups on one side and said tank groups on the other side, one end of said communicating pipe communicates with a pipe insertion hole that is formed at a bottom center position of said end plate and said intake/outlet passage forming plate that is bonded onto said end plate and which communicates with said second coolant passage, and the other end of said communicating pipe communicates with a second pipe insertion hole that is formed in an extended portion that extends out toward said pipe insertion groove from a tank in a tank group constituting the other end of said coolant path.

14. The heat exchanger according to claim 1 wherein:

said communicating pipe is provided in a pipe insertion groove which is formed between said tank groups on one side and said tank groups on the other side, one end of said communicating pipe communicates with said pipe insertion hole that is formed at a bottom center position of said end plate and said intake/outlet passage forming plate that is bonded onto said end plate and which communicates with said second coolant passage, and the other end of said communicating pipe communicates astride with the communicating passages formed by extending out toward said pipe insertion groove from at least two tanks which are not adjacent to each other in a tank group constituting the other end of said coolant path.

15. The heat exchanger according to claim 1 wherein:

said communicating pipe is provided in a pipe insertion groove which is formed between said tank groups on one side and said tank groups on the other side, one end of said communicating pipe communicates with said pipe insertion hole that is formed at a bottom center position of said end plate and said intake/outlet passage forming plate that is bonded onto said end plate and which communicates with said second coolant passage, and the other end of said communicating pipe communicates with a communicating passage formed by extending out toward said pipe insertion groove from a tank constituted with two continuous formed plates that belong to a tank group constituting the other side of said coolant path.

16. The heat exchanger according to claim 15 wherein:

said communicating passage is formed by extending a tank forming area of a pair of formed plates that are bonded facing each other, out toward said pipe insertion groove.

17. The heat exchanger according to claim 15 wherein:

said communicating passage is formed by extending a tank forming area of a pair of formed plates that are bonded back-to-back, out toward said pipe insertion groove, said communicating pipe is provided in a pipe insertion groove which is formed between said tank groups on one side and said tank groups on the other side, one end of said communicating pipe communicates with said pipe insertion hole that is formed at a bottom center position of said end plate and said intake/outlet passage forming plate that is bonded onto said end plate and which communicates with said second coolant passage, and the other end of said communicating pipe communicates with a communicating passage formed in an extended portion that extends out toward said pipe insertion groove from a tank which is located at a specific position outside of a center of a tank group that constitutes the other end of said coolant path.

18. The heat exchanger according to claim 1 wherein:

said communicating pipe is provided with guides formed by notching, in a direction of flow of the coolant, both ends of the pipe which are inserted into said pipe insertion hole and a second pipe insertion hole notching.

* * * * *